US006196296B1

(12) United States Patent
Wisniewski et al.

(10) Patent No.: US 6,196,296 B1
(45) Date of Patent: Mar. 6, 2001

(54) FREEZING AND THAWING VESSEL WITH THERMAL BRIDGE FORMED BETWEEN CONTAINER AND HEAT EXCHANGE MEMBER

(75) Inventors: Richard Wisniewski, San Mateo; Leonidas Cartwright Leonard, Walnut Creek, both of CA (US)

(73) Assignee: Integrated Biosystems, Inc., Benicia, CA (US)

( * ) Notice: Subject to any disclaimer, the term of this patent is extended or adjusted under 35 U.S.C. 154(b) by 0 days.

(21) Appl. No.: 08/895,782

(22) Filed: Jul. 17, 1997

Related U.S. Application Data

(60) Provisional application No. 60/037,283, filed on Feb. 4, 1997.

(51) Int. Cl.[7] ..... F25B 29/00; C12M 3/00

(52) U.S. Cl. ..... 165/47; 165/109.1; 165/142; 165/169; 165/DIG. 346; 165/DIG. 349; 165/61; 62/73; 62/352; 422/109; 435/307.1; 435/298.1

(58) Field of Search ..... 165/154, 161, 165/142, 47, DIG. 349, DIG. 500, 169, 109.1, 61, DIG. 346; 62/78, 66, 340, 72, 73, 349, 352, 353; 422/109; 435/307.1, 298.1

(56) References Cited

U.S. PATENT DOCUMENTS

| | | | | |
|---|---|---|---|---|
| 876,015 | * | 1/1908 | Ray . | |
| 983,466 | * | 2/1911 | Voorhees . | |
| 1,874,578 | * | 8/1932 | Morrison | 165/142 |
| 2,129,572 | * | 9/1938 | Finnegan . | |
| 2,391,876 | * | 1/1946 | Brown | 165/169 |
| 2,405,091 | | 7/1946 | Culbreth | 62/149 |
| 2,441,376 | | 5/1948 | Stiening | 62/89 |
| 2,449,343 | | 9/1948 | Torbensen | 52/99 |
| 2,605,620 | * | 8/1952 | Taylor . | |
| 2,610,034 | * | 9/1952 | Lundvall et al. | 165/DIG. 349 |
| 2,704,656 | * | 3/1955 | Freer . | |
| 2,915,292 | * | 12/1959 | Gross | 165/169 |
| 2,942,430 | * | 6/1960 | Rising et al. | 62/352 |
| 3,074,246 | * | 1/1963 | Wilbushewich . | |
| 3,108,840 | | 10/1963 | Conrad et al. | 312/214 |
| 3,147,799 | * | 9/1964 | Chadburn et al. | 165/142 |
| 3,181,309 | * | 5/1965 | Wilbushewich | 62/73 |
| 3,308,552 | * | 3/1967 | Kaufman et al. . | |
| 3,318,105 | * | 5/1967 | Burroughs et al. . | |
| 3,453,416 | * | 7/1969 | Mekjean | 165/142 |
| 3,464,228 | * | 9/1969 | Hitchcock | 62/352 |
| 3,550,393 | * | 12/1970 | Euwema | 165/154 |

(List continued on next page.)

FOREIGN PATENT DOCUMENTS

| | | |
|---|---|---|
| 18668/83 | 2/1983 | (AU) . |
| 12751/83 | 6/1983 | (AU) . |
| 0 316 966 B1 | 5/1989 | (EP) . |

(List continued on next page.)

OTHER PUBLICATIONS

Gore, H.C., "Apple Sirup and Concentrated Cider: New Product for Utilizing Surplus and Cull Apples", Yearbook of the Department of Agriculture, 1914, pp. 227–244.

(List continued on next page.)

*Primary Examiner*—John K. Ford
(74) *Attorney, Agent, or Firm*—Wilson Sonsini Goodrich & Rosati; David J. Abraham

(57) ABSTRACT

The present invention relates to a thermal transfer method for heating or cooling a biopharmaceutical medium. A structure is positioned in the container. A heat exchange member is coupled to an interior surface of the container wherein a distal end of the heat exchange member is placed in close proximity to the structure to allow formation of a thermal transfer bridge that conducts heat into or out of the medium.

21 Claims, 18 Drawing Sheets

U.S. PATENT DOCUMENTS

| | | | | |
|---|---|---|---|---|
| 3,595,308 | | 7/1971 | Durdin | 165/107 |
| 3,764,780 | | 10/1973 | Ellis | 219/430 |
| 3,934,618 | * | 1/1976 | Henderson | 138/114 |
| 3,976,129 | * | 8/1976 | Silver | 165/154 |
| 4,200,148 | * | 4/1980 | Friefeld et al. . | |
| 4,241,043 | * | 12/1980 | Hetzel | 165/141 |
| 4,296,612 | * | 10/1981 | Allo | 165/141 |
| 4,337,079 | | 6/1982 | Mann, Jr. et al. | 71/34 |
| 4,344,479 | | 8/1982 | Bailey | 165/109 R |
| 4,426,959 | | 1/1984 | McCurley | 122/33 |
| 4,509,344 | | 4/1985 | Ludwigsen et al. | 62/76 |
| 4,512,388 | | 4/1985 | Claar et al. | 165/1 |
| 4,531,373 | | 7/1985 | Rubinsky | 62/63 |
| 4,584,843 | | 4/1986 | Pronger, Jr. et al. | 62/123 |
| 4,596,120 | | 6/1986 | Knodel et al. | 62/59 |
| 4,609,036 | * | 9/1986 | Schrader . | |
| 4,712,607 | * | 12/1987 | Lindemans et al. | 165/30 |
| 4,793,151 | * | 12/1988 | Masel | 62/342 |
| 4,976,308 | | 12/1990 | Faghri | 165/10 |
| 5,005,371 | | 4/1991 | Yonezawa et al. | 62/238.6 |
| 5,022,149 | | 6/1991 | Abbott | 29/890.048 |
| 5,029,634 | * | 7/1991 | Hurner | 165/142 |
| 5,033,544 | | 7/1991 | Abbott | 165/184 |
| 5,054,548 | | 10/1991 | Zohler | 165/133 |
| 5,072,569 | | 12/1991 | VanTassel | 52/745 |
| 5,090,207 | | 2/1992 | Gilbertson et al. | 62/59 |
| 5,168,725 | | 12/1992 | Margolin | 62/457.9 |
| 5,176,197 | | 1/1993 | Hamaguchi et al. | 164/459 |
| 5,181,387 | | 1/1993 | Meckler | 62/59 |
| 5,212,957 | | 5/1993 | Ruff | 62/124 |
| 5,217,138 | * | 6/1993 | Nichols | 220/403 |
| 5,220,954 | | 6/1993 | Longardner et al. | 165/10 |
| 5,332,034 | | 7/1994 | Chiang et al. | 165/184 |
| 5,411,078 | | 5/1995 | Ares | 165/113 |
| 5,458,191 | | 10/1995 | Chiang et al. | 165/133 |
| 5,520,885 | | 5/1996 | Coelho et al. | 422/101 |
| 5,524,706 | * | 6/1996 | Nakamura et al. | 62/352 |
| 5,579,830 | | 12/1996 | Giammaruti | 165/104.27 |
| 5,609,035 | * | 3/1997 | Cothern et al. | 62/73 |
| 5,644,922 | * | 7/1997 | Linden et al. | 62/78 |

FOREIGN PATENT DOCUMENTS

| | | | |
|---|---|---|---|
| 0 618 413 A1 | | 10/1994 | (EP) . |
| 0316966 | * | 3/1995 | (EP) . |
| 2 237 156 | | 2/1975 | (FR) . |
| 518301 | | 2/1940 | (GB) . |
| 845576 | * | 8/1960 | (GB) . |
| 2 092 880 | | 8/1982 | (GB) . |

OTHER PUBLICATIONS

Stahl, A.L., "Concentration of Citrus Juices by Freezing", Florida State Horticultural Society, 1944, pp. 43–45.

Lawler, Frank K., "Engineering Advances FREEZE–Concentration", Food Engineering, vol. 23, No. 10, Oct. 1951, pp. 68–71, 210–213.

Schwarz, H.W., et al., "Production of Orange Juice Concentrate and Powder", Industrial and Engineering Chemistry, vol. 40, No. 5, May 1948, pp. 938–944.

Burton, R. et al., "An experimental investigation of the solidification process in a V–shaped sump", Int. J. Heat Mass Transfer, vol. 38, No. 13, (1995), pp. 2383–2393.

Wisniewski, R. et al., "Large–Scale Freezing and Thawing of Biopharmaceutical Products", Biotech. and Biopharm. Manufacturing, Processing and Preservation, Interpharm Press, Illinois, 1996, pp. 7–58.

Wisniewski, Richard et al, "1996 Proceedings", Advanstar Communications, pp. 385–392 (1996), a reprint of an article by the same name previously published in the Parenteral Drug Association Proceedings of the International Congress on Advanced Technologies for Manufacturing of Aseptic & Terminally Sterilized Pharmaceuticals and Biopharmaceuticals, Basel, Switzerland 17–19 Feb. 1992.

Kalhori, B. et al., "Studies on Heat Transfer From a Vertical Cylinder, With or Without Fins, Embedded in a Solid Phase Change Medium", *Transactions of the ASME*, Journal of Heat Transfer, vol. 107, Feb. 1985, pp. 44–51.

* cited by examiner

Section of the vessel with internal finned Heat exchanger

FREEZING AND THAWING VESSEL WITH THERMAL BRIDGE FORMED BETWEEN CONTAINER AND HEAT EXCHANGE MEMBER

CROSS-REFERENCE TO RELATED APPLICATIONS

This application claims the benefit of Provisional Application Serial No. 60/037,283, filed Feb. 4, 1997, hereby incorporated by reference. The present application is related to U.S. patent application Ser. No. 08/895,777, filed Jul. 17, 1997, entitled "Freezing and Thawing Vessel with Thermal Bridge Formed Between Internal Structure and Heat Exchange Member," having same named inventors Richard Wisniewski, Leonidas Cartwright Leonard, hereby incorporated by reference and U.S. patent application Ser. No. 08/895,936, filed Jul. 17, 1997, entitled "Freezing and Thawing Vessel with Thermal Bridge Formed Between Heat Exchange Members," having same named inventors Richard Wisniewski, Leonidas Cartwright Leonard, hereby incorporated by reference.

FIELD OF THE INVENTION

The present invention relates generally to systems containing structures such as fins to aid in the transfer of heat into or out of a medium. More particularly, the present invention relates to heating and cooling structures which are suited for use in heat, cooling, thawing, and freezing biopharmaceutical products.

DESCRIPTION OF THE PRIOR ART

Typically, a container used to heat or cool a medium will have a heat exchange fluid circulated in tubes placed in or around the exterior of the container. In order to improve the transfer of heat to or from the medium to the heat exchange fluid, one or more extensions of the container or any structures in the container may be used to increase the surface area of the system that is in contact with the medium.

Ordinarily, fins will be attached by one end to a portion of the container or some other structure in the container, and the fins will conduct heat to or from that portion of the container. However, since a fin is typically attached to the container or an internal structure at only one point, all of the heat transferred to or from the fin to the container or an internal structure must enter or leave the fin through the one connection that the fin has with the rest of the system.

One configuration that has been used to solve this problem is to build a system in which one or more of the fins are rigidly attached to both the container and an internal structure within the container. This allows heat to be transferred to or from a fin through two portions of the fin, increasing the rate at which heat is put into or withdrawn from a medium placed in the container.

However, by rigidly attaching a fin between the container and a structure within the container, the structure within the container itself then becomes rigidly attached to the container. The rigid attachment of the structure inside the container can make cleaning and decontaminating the container more difficult. Additionally, it may be more difficult to manufacture the system because, for example, tighter tolerances may be required so that the fin can be attached to two surfaces within the container, and each fin may require two or more welded joints. Furthermore, it may be inconvenient, costly, or impossible for fins made of certain materials to be welded to a container.

What is needed is a system in which heat can be put into or withdrawn from a fin through more than one portion of the fin while the system is operating while enabling structures within the container to be removed to allow for cleaning and decontaminating of the system. Furthermore, what is needed is a system in which it is not required to physically connect or weld the fin to a portion of the container in order for heat to be transferred into or out of a portion of the fin.

SUMMARY OF THE INVENTION

It is an object of the present invention to have a system in which heat can be transferred into or out of a system through heat conduction pathways which are partially comprised of the medium being heated or cooled such that heat flows between different portions of the system by flowing through the medium.

It is an object of the present invention to have a system in which heat can be transferred into or out of a structure within the container (e.g. a fin) through more than one portion of the structure. (The term "fin" will be used generically to mean any heat exchange member of the system that extends into the medium, including but not limited to a coil, a flattened protrusion, a tube, or any other structure extending into the container. Where a particular type of extension of the container is being discussed, such as a coil, the name of the particular type of extension may be used to help clarify the configuration of the system.)

It is a further object of the present invention to have a system in which structures within the container can be removed to allow for cleaning and decontaminating of the system.

It is yet a further object of the present invention to have fins which contain passageways allowing cooling fluid to flow within the fins.

It is another object of the present invention to have fins which enhance the removal of heat from a medium but which are not rigidly attached to another portion of the system.

It is yet another object of the present invention to have fins which have non-uniform cross-sections to allow from more rapid removal of heat from a medium in the system.

It is still another object of the present invention to have a system that achieves controlled freezing rates for a medium such as a pharmaceutical product to aid in cryopreservation.

It is a yet another object of the present invention to have a system which encourages a controlled freezing process to promote dendritic ice growth to aid in the cryopreservation of mediums including but not limited to proteins, cells, blood, plasma, other biopharmaceutical products, or food products.

It is a further object of the present invention to have a system that can rapidly heat or cool a medium.

These and other objects of the present invention are achieved by the use of a structure positioned in the container. A heat exchange member is at least partially coupled to an interior surface of the container wherein a distal end of the heat exchange member is placed in close proximity to the structure to allow formation of a thermal transfer bridge that conducts heat into or out of the medium.

In one embodiment of the present invention, since the fin, and the container are not rigidly attached the structure can be removed from the container.

When a medium inside the container is frozen, a bridge made of the frozen medium will form between the distal end of the fin and the portion of the container close to the distal end of the fin. This bridge will allow heat to be conducted to or from the fin across the bridge speeding the removal of heat from the medium.

In one embodiment of the present invention, the fin is at least partially attached to a structure within the container allowing heat to be transferred out of the fin through the attachment point and the thermal bridge when it is formed.

In another embodiment of the present invention, the distal end of the fin is placed close enough to another surface of the container, for example, another fin or structure in the container, such that when the medium is cooled, the thermal transport bridge is formed between the fin and the other structure in the container—which may of course be a fin.

The present invention is useful for both the cooling and heating of a medium. When a medium is being frozen the thermal bridges help transfer heat out of the medium. When the medium is being heated the thermal bridges help heat to be transferred into the medium.

The medium can also be a gas being converted to a liquid or a liquid being converted to a gas. In these cases the liquid phase of the medium that collects between the fin and the structure will act as the thermal bridge to enhance the conduction of heat between the fin and the structure.

Additionally, the fin can have structures on it which will enhance the formation of solid or liquid thermal bridges and/or enhance the heat conduction through such bridges. For example, a portion of the fin may be enlarged to provide more surface area for conduction and contact with a thermal bridge, or the fin may be tailored to enhance nucleation of the solid or condensation of the liquid. Also, a fin may have a non-uniform cross-section to enhance thermal transport or achieve desired thermal transport characteristics. This may be desirable to help achieve cryobiology protocols. Furthermore, the fin can have interior channels that allow a heat exchange medium to flow within at least a portion of the fin. Other variations are possible without departing from the spirit of the invention.

The system may be configured so that a heating or cooling device is coupled to any portion of the container. For example, without departing from the present invention, a heater or cooler could be attached to an exterior portion of the container (e.g. a wall of the container), to an internal structure of the container, or directly to one or more of the fins.

In general, the system should be constructed such that the distance to be bridged by the thermal transport bridge will be a function of the thermal properties of the medium and the system, manufacturing requirements and construction processes used to build the system, and other relevant parameters of the system and components used. The size of the gap to be filled by the bridge can be determined through simple trial and error.

In one aspect of the present invention, the fins may be structures of any shape which are placed against or wedged between surfaces in the container. Thermal bridges will then form between the fins and the adjacent surface or surfaces of the container. For example, the fins can have ends adapted to fit in preconfigured slots in surfaces of the container. In this way the fins can be reconfigurable attached to portions of the container so that the number, configuration, and type of the fins used can be easily changed to meet changing manufacturing, process, or protocol needs.

In one aspect of the present invention, the optimum gap is proportional to the thickness of the fin. In another aspect of the present invention, the optimum gap is less than 2 inches, preferably less than 1 inch, more preferably less than ½ inch, even more preferably less than ¼ inch, and most preferably less than ⅛ inch.

Without departing from the present invention, the container can be porous and need not have a top or a bottom. The medium can be heated or cooled as it passes through the container. Additionally, the container used in the present invention is not limited in shape, size or material from which it is constructed. In one aspect of the present invention, the container may have a volume of 1 liter to 5 liters, 1 liter to 250 liters, or 250 to 10,000 liters.

The present invention can be usefully applied in many fields. For example in the biopharmaceutical industry the present invention can be used to freeze and preserve a variety of biopharmaceutical products, including but not limited to proteins, cells, antibodies, medicines, plasma, blood, buffer solutions, viruses, serum, cell fragments, cellular components, and any other biopharmaceutical product.

Additionally, the present invention allows processing of such biopharmaceutical products consistent with generally accepted manufacturing procedures.

One could use the present invention to freeze a biopharmaceutical product by sterilizing the container, pumping the product to be frozen into the container through a sterile filter and then removing heat from the product using the present invention to freeze the product within the container.

The present invention promotes uniform freezing at a rapid pace which allows the product in the container to be frozen in as close to its native state as possible. Additionally, the present invention allows the freezing process to be done in a repeatable fashion so that a user can be assured that the freezing process is not causing batch to batch variations in the product. This allows the end use of the product to be decoupled from the manufacturing steps needed to create the product since the product can be stored in the frozen state after it is manufactured, and thawed when and where it is needed.

The present invention can also be used during any stage of a purification process. For example, after products are processed using size separation or affinity separation, fermentation, licing, concentration filtration, selective affinity chromatography, removal of micro contaminants or low level impurities through ion exchange, viral filtration, chromatography, putting the product in a buffered solution delivery system, or after any other processing step the resulting product can be stored using the present invention. This allows a hold to be put on the manufacturing process without degrading the intermediate product.

For example, if during a manufacturing process in which various components are being separated, one wishes to put a hold on the processing, there may be contaminating proteaises in the intermediate product which may, over time, degrade some of the proteins of interest in the product. The present invention can be used to freeze the intermediate product quickly and uniformly enough so that the product remains close to its native state. The molecules in the product are not brought significantly closer together—freeze concentration is reduced, and unwanted reactions can be slowed or stopped.

Thus, the present invention can be used to increase the flexibility of a manufacturing process, making planning and scheduling of the process easier. Intermediate products can be frozen for later processing or shipping. Additionally, since the present invention can be scaled to any size desired, large batches of products can be prepared all at once, preserved using the present invention, and used as needed at a later time.

DETAILED DESCRIPTION

Figure 1:
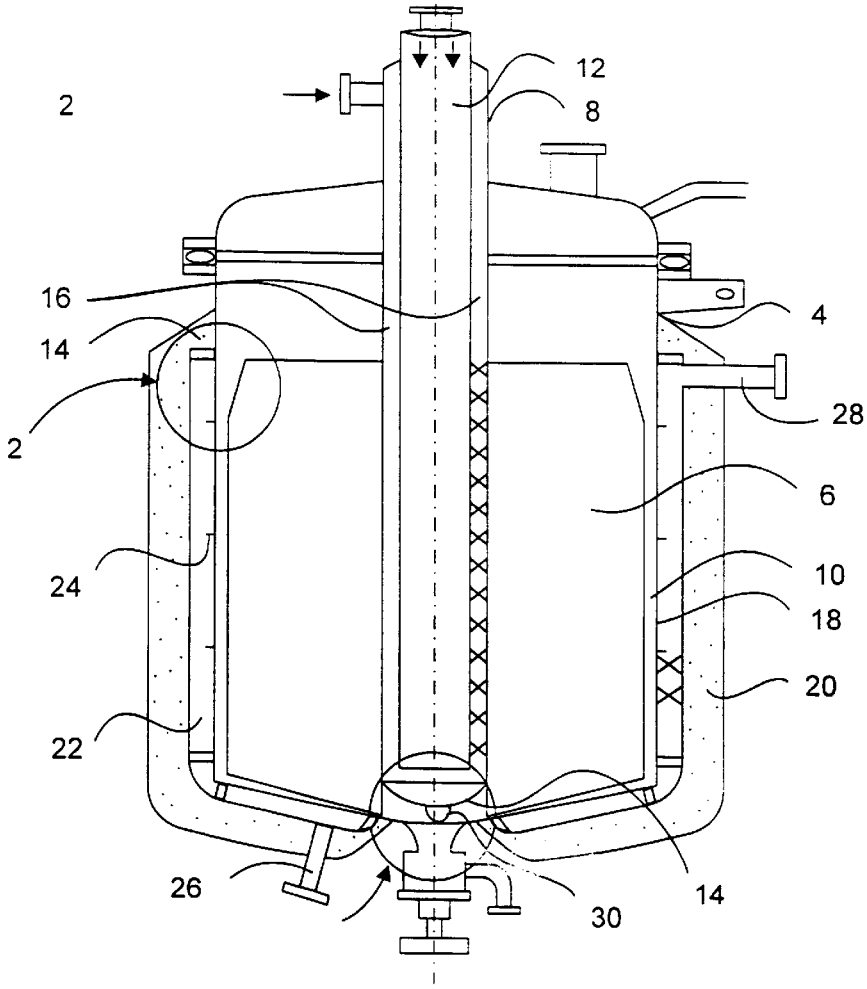
FIG. 1 is a side view of the finned heating and cooling apparatus.

One embodiment of the present invention is shown in FIG. 1. Heating and cooling system 2 is comprised of container 4, fins 6 and structure 8. Fins 6 are configured such that they are placed in close proximity to interior surface 10 of container 4. Generally, a small gap between fin 6 and interior surface 10 is preferable. However, the size of this gap may be dictated by manufacturing tolerances, material parameters, or other practical considerations.

Figure 2:
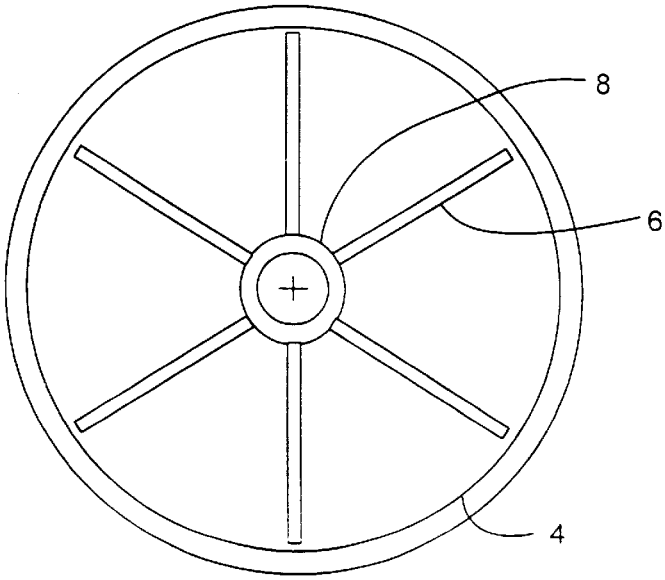
FIG. 2 is a top view of the fins and the structure within the container depicted in FIG. 1.

FIG. 2 shows a cutaway top view of container 4, fins 6 and structure 8. In the present embodiment there are 6 fins placed symmetrically about structure 8. Any arrangement design, configuration, or number of fins could be used without departing from the present invention. For example, the fins need not be symmetrically positioned within the container, they need not be the same shape and they need not be made of the same material.

Referring again to FIG. 1, structure 8 is heated or cooled by flowing a heat exchange fluid down interior passage 12 towards end piece 14. The heat exchange fluid then flows up through the outer passage 16 of structure 8. This flow pattern of the heat exchange fluid and the symmetric configuration of the fins about structure 8 aids system 2 to begin cooling the medium in the container from the bottom up. This is so because the heat exchange fluid is first closely coupled to the medium in the container and the fins at the bottom of the container.

Cooling the medium from the bottom up is particularly advantageous when a liquid medium is being frozen and, as is true for water, the density of the frozen medium is less than that if the liquid phase. Freezing from the bottom up prevents pressure from building up as might be the case if the liquid phase was constrained by the solid phase.

It should be appreciated that one skilled in the art could use other flow patterns, fin shapes, and fin configurations to induce the medium to heat or cool in any preferred direction, uniformly, and/or at a specified rate without departing from the present invention. Additionally, parameters of the heat exchange fluid such as flow rate and/or temperature can be used to affect the rate at which the medium is cooled.

End piece 14 has bottom fin 30 attached to it. Bottom fin 30 functions the same as fins 6. A thermal transport bridge is formed between bottom fin 30 and a portion of interior surface 10.

In one aspect of the present invention, taper 19 on fin 6 helps to slow the formation of a thermal bridge on the upper portion of fin 6. This will slightly slow the heat transfer out of the upper portion of the container, allowing the system to freeze the medium from the bottom up. Such a taper can be used on any portion of the fin to help create a preferred direction for removal of heat from the container.

Container 4 has jacket 20 surrounding its circumference. Between exterior surface 18 of container 4 and jacket 20 is fluid flow path 22. Spiral baffle 24 corkscrews around container 4 between exterior surface 18 and jacket 20 forcing heat exchange fluid in fluid flow path 22 to flow in a spiraling path around the exterior surface 18 of container 4. Heat exchange fluid flows into fluid flow path 22 through port 26 and out through port 28 resulting in the heat exchange fluid flowing around container 4 from the bottom to the top. This flow pattern for the heat exchange fluid aids system 2 in cooling the medium in the container from the bottom up.

It should be appreciated that other fluid flow patterns and baffles can be used to induce the medium to heat or cool in any preferred direction, uniformly, and/or at a specified rate without departing from the present invention. Additionally, parameters of the heat exchange fluid such as flow rate and/or temperature can be used to affect the rate at which the medium is cooled.

Furthermore, the heat exchange fluid can be flowed through the system at other points and in a time or process varying manner in order to tailor the timing, direction, and rate of heat flow into or out of the system. Additionally, materials used in, or the shape, or configuration of the system, including the fins, can be used to control parameters of the heating or cooling process such as rate, timing or directionality.

When container 4, structure 8 and fins 6 are cooled by the coolant, the medium in the container begins to cool. When the medium is sufficiently cooled, a portion of the medium between the distal end of fins 6 and interior surface 10 will freeze. This frozen bridge will allow heat to be conducted between fins 6 and container 4 through the frozen bridge. This will enable heat to be taken out of the medium at a higher rate, speeding the freezing of the medium in the container. The present invention will work with any type of medium including but not limited to biopharmaceutical products.

FIG. 3 illustrates the formation of thermal bridges in accordance with one aspect of the present invention. FIG. 3*a* is a top view of one embodiment of the present invention in which structure 31 has 8 fins 32 attached to it. Each fin 32 extends close to interior surface 33 of container 34.

Figure 3A:
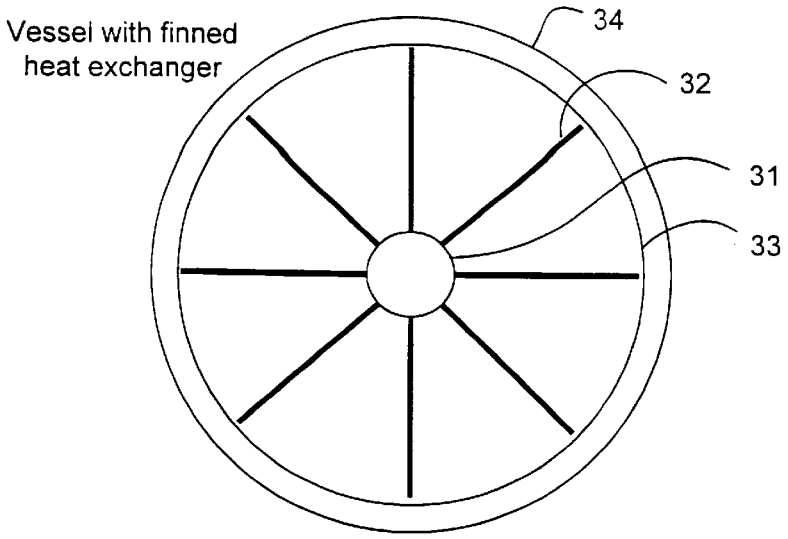
FIG. 3 depicts the formation of thermal bridges and graphs showing the temperature profile of various cross-sections of the container and medium.
Figure 3B:
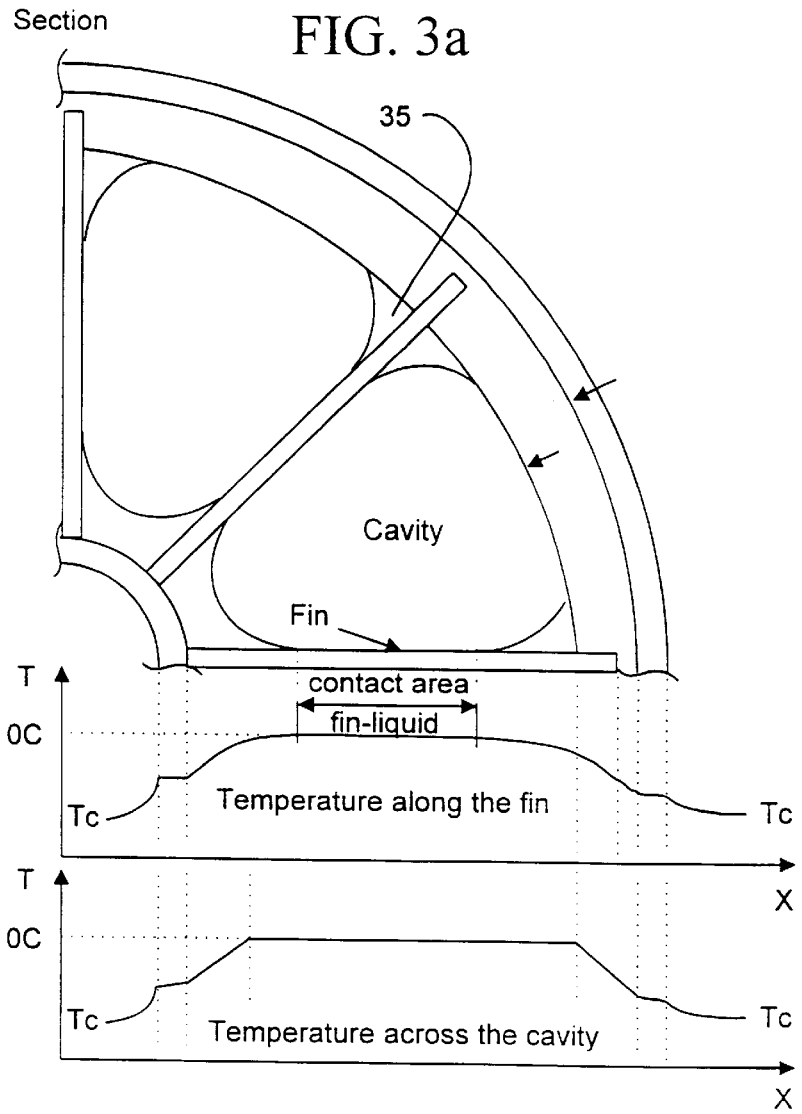

FIG. 3*b* illustrates a simulation for the system shortly after thermal bridges 35 have begun to form. In this simulation, the material properties of 315 stainless steel were used for the container and the fins, and the coolant temperature was −45° C. The temperature of the liquid was −0.2° C., the temperature of the fin in contact with the liquid was close to −0.2° C., and the temperature of the portion of the fin in contact with the frozen product was declining toward the temperature of the wall. The temperature of the wall was within 2–5° C. of the temperature of the coolant.

Figure 3C:
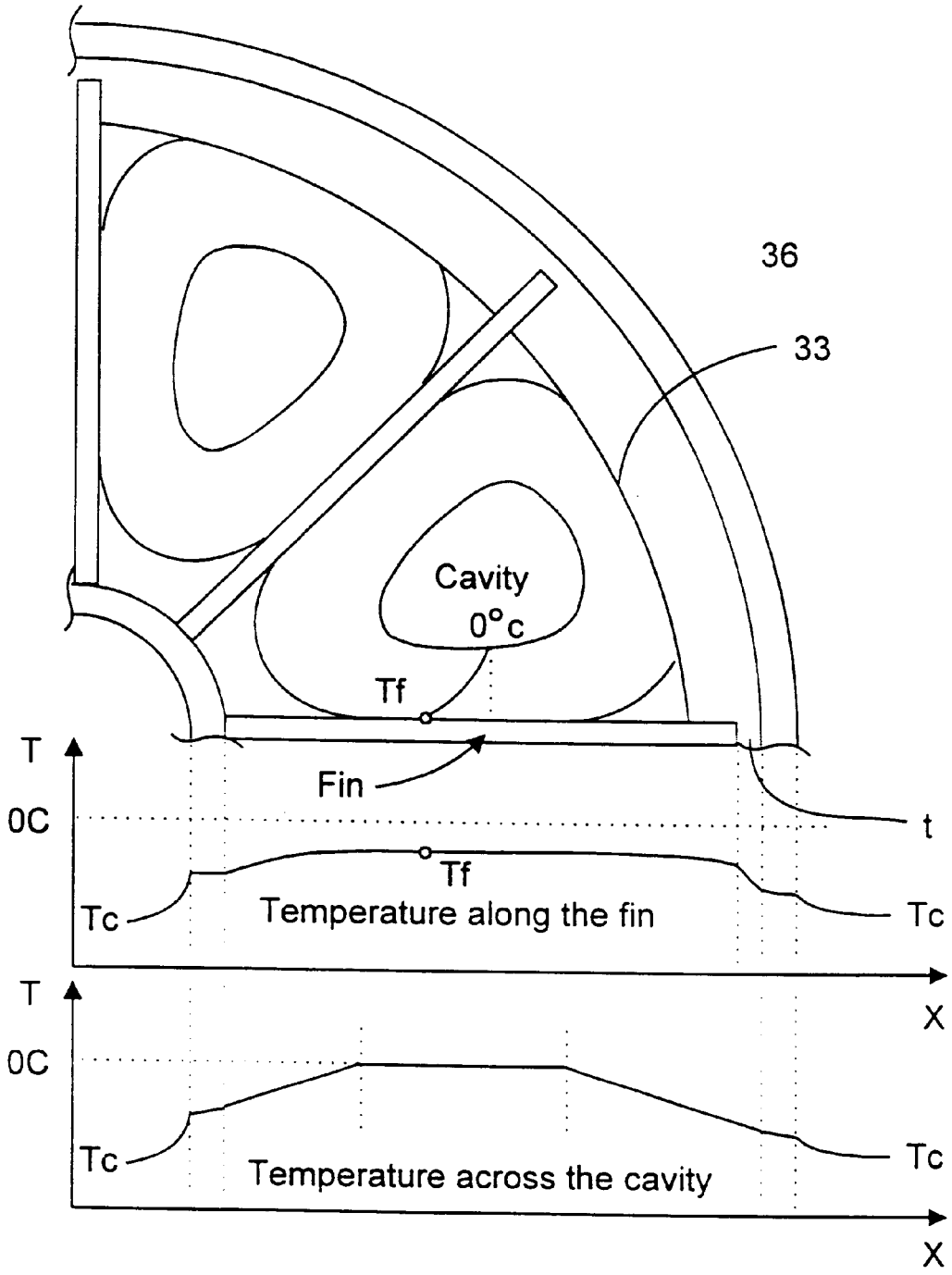

As can be seen from the graphs in FIG. 3*b*, heat is being extracted from fins 32 through both ends. When compared to a finned structure in which heat is extracted form only one end of the fin, the medium will be cooled at a faster rate. FIG. 3*c* depicts the temperature profile of the medium within the compartments 36 formed by fins 32. As shown in the graphs in FIG. 3*c*, heat is withdrawn from the medium within the cavity through interior container wall 33, structure 31 and fins 32.

The relative uniformity with which the present invention allows heat to be removed from the medium promotes the growth of dendritic structures during the freezing process. The present invention, by allowing heat to be removed from both ends of a fin, helps to create a uniform temperature profile within the container. Additionally, the fins can be positioned to effectively segment the container into a plurality of smaller volumes, so that heat can be more uniformly removed from each segmented section. As an example, FIG. 2 shows container 4 segmented into 6 section by the fins.

It is noted that the present invention can be used to achieve dendritic ice growth even if fins are rigidly attached at more than one point to the system. Fins can be used to segment the container into small regions which can be more uniformly heated and cooled. Thus, if a particular application does not require that the internal structures of the container be removable, the fins and structures can be permanently attached within the container.

Figure 3D:
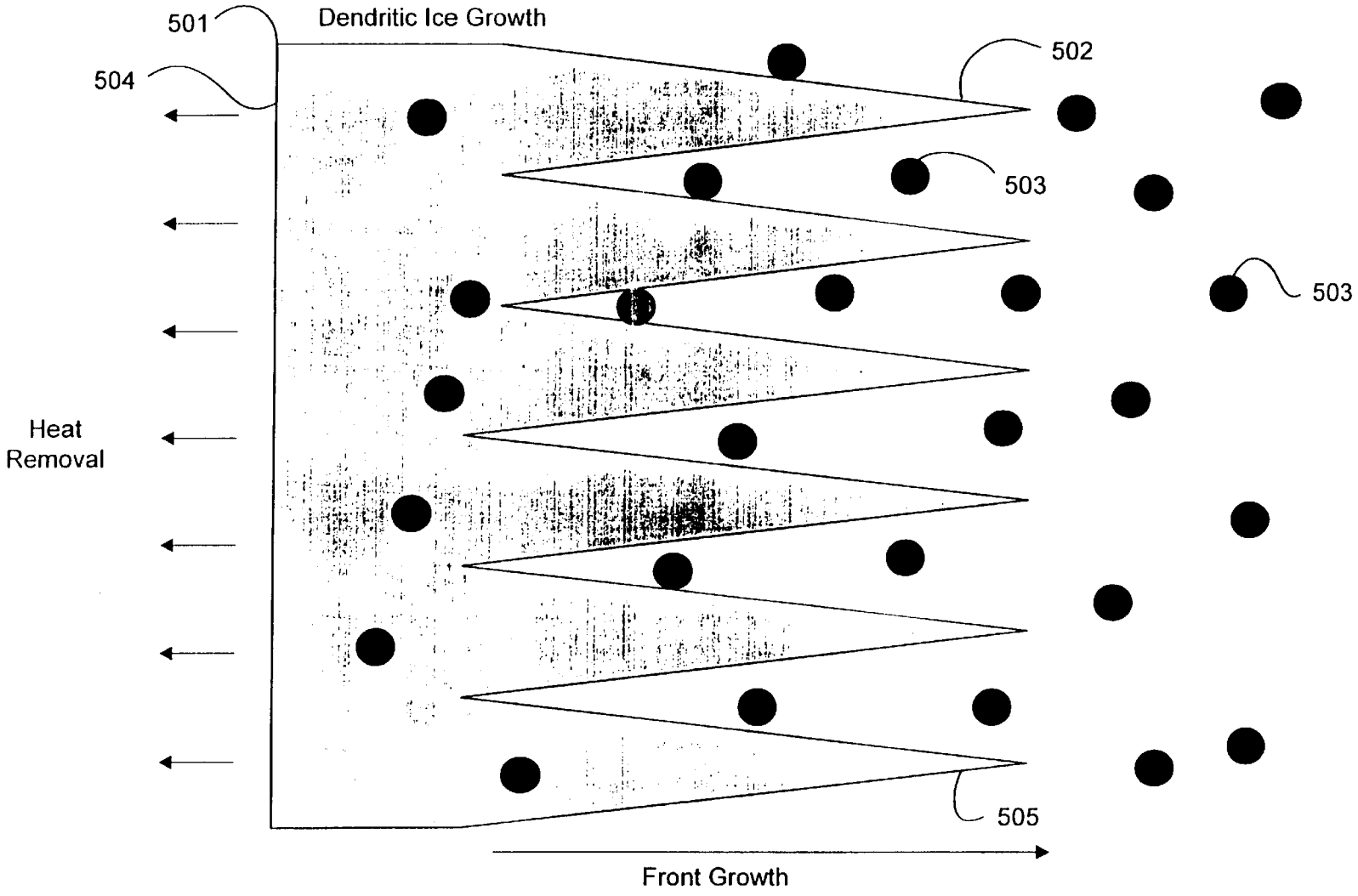

Dendritic ice growth is particularly useful many areas, including but not limited to the cryopreservation of biopharmaceutical products. As shown in FIG. 3*d*, when heat is removed from surface 501 (which could be any surface of the present invention), dendrites 502 will form and grow moving away form surface 501. As dendrites 502 grow, the substance 503 in the medium being frozen and will eventually become surrounded by dendrites 502. As dendrites 502 grow, substance 503 will eventually become trapped in the frozen medium 504. By controlling the heat removal from surface 501, the growth rate of dendrites 502 can be controlled. Controlling the growth rate of dendrites 502 allows the present invention to be used to control the amount of liquid removed from substance 503 as it enters and becomes trapped by growing dendritic front 505. It is noted that substance 503 can be any substance one desires to preserve.

It should be appreciated that there need not be active cooling of both the structure and the container to employ the present invention. Without departing from the present invention, coolant can be circulated through any part of the system, only one part of the system, or coolant need not be used and the system could be cooled by other means or indirectly or passively.

In another embodiment of the invention, removable liners can be placed over the distal ends of fins 6 to prevent them from contacting interior surface 10 when structure 8 and fins 6 are inserted or removed from container 4. This may be desired, for example, to avoid scratching interior surface 10 with fins 6 during assembly and disassembly.

Figure 4:
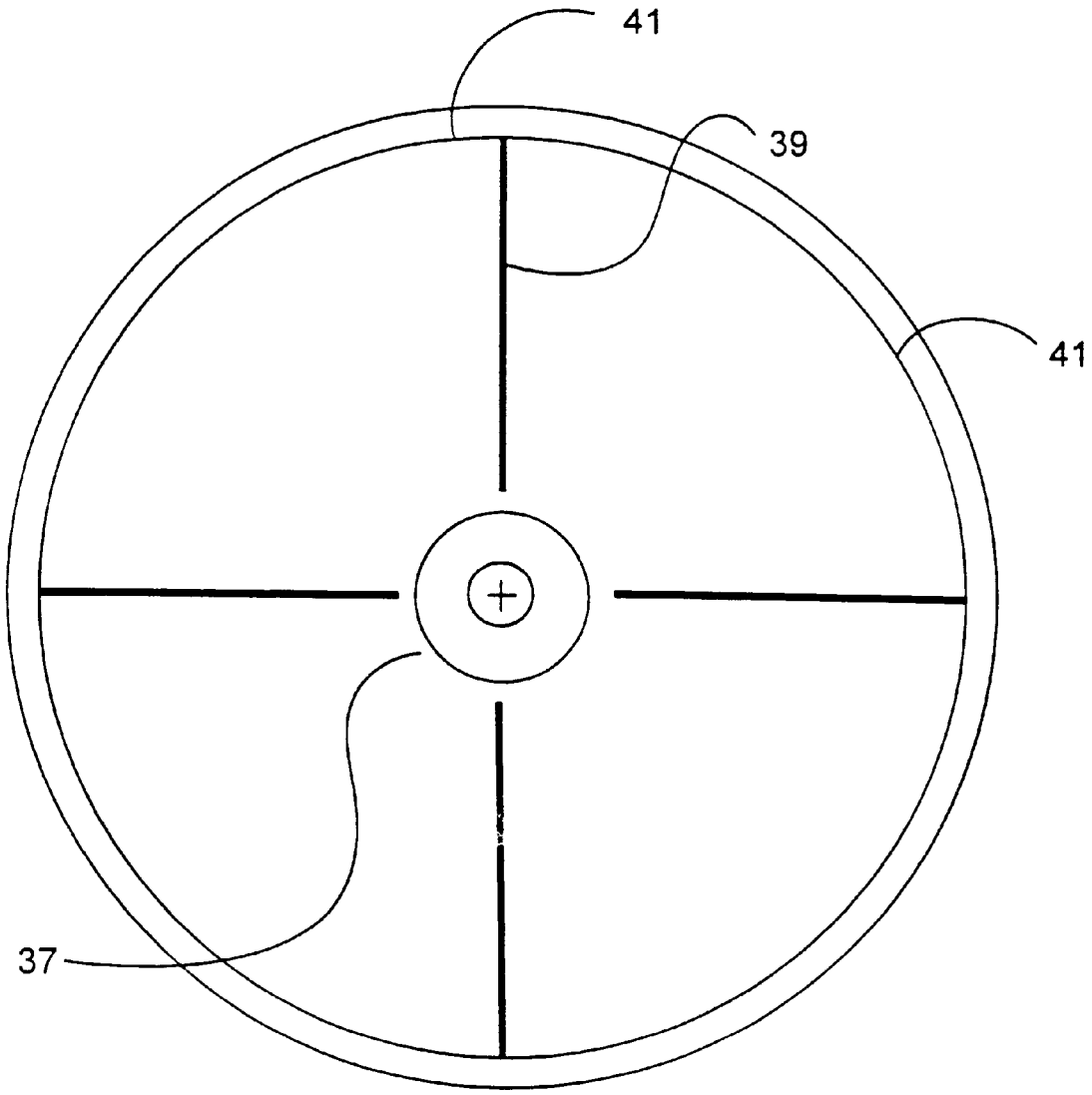
FIG. 4 is another possible arrangement of the fins.

Other fin configuration are possible without deviating from the present invention. For example, in FIG. 4, fins 39 may be partially coupled to interior container wall 41 and the distal end of each fin can be place in close proximity to structure 37 such that the thermal bridge is formed between a distal end of each of fins 39 and structure 37.

Figure 5:
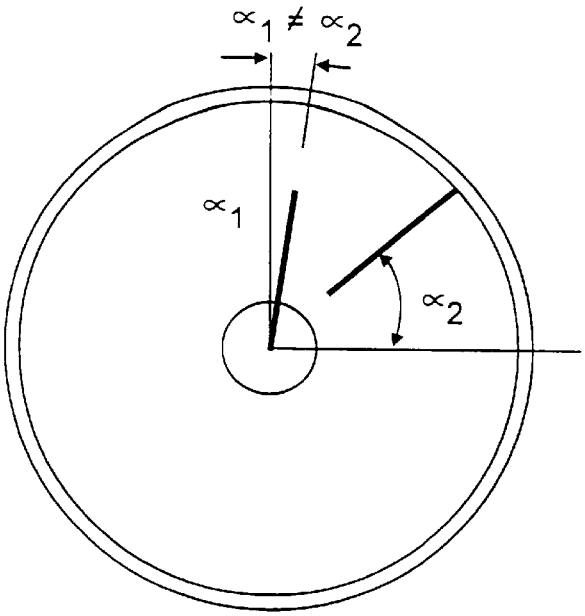
FIG. 5 is yet another possible arrangement of the fins.
Figure 5:
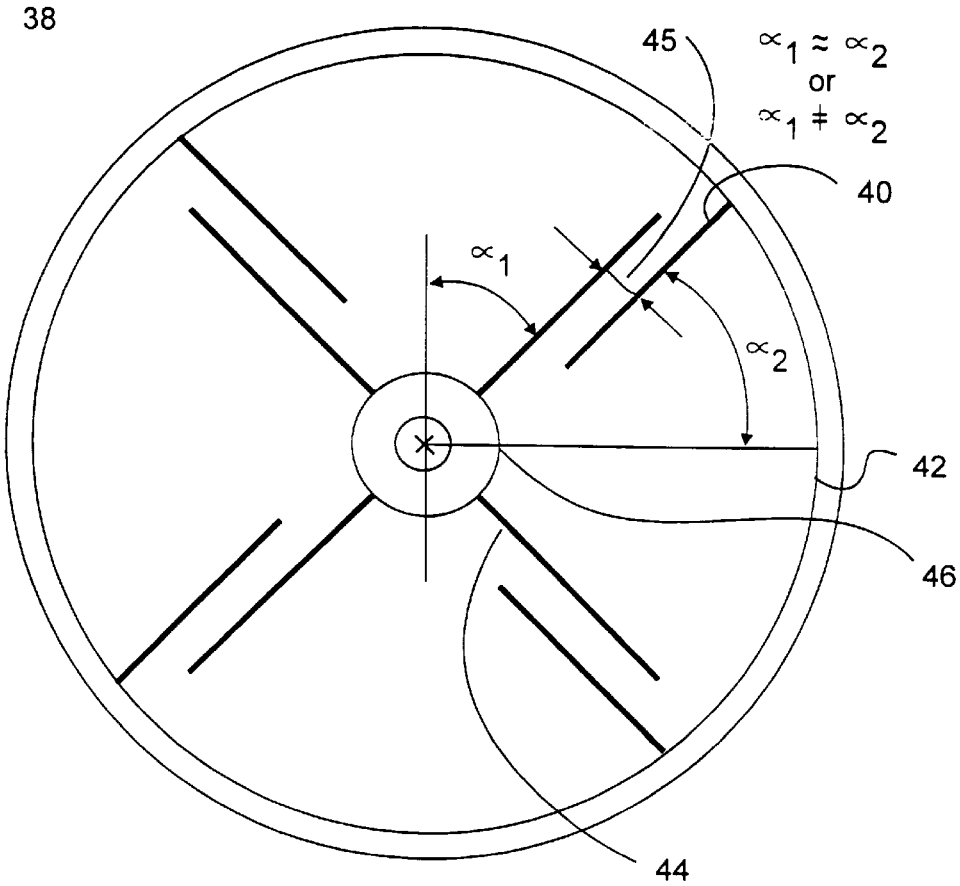

In FIG. 5, fins 40 are attached to interior surface 42. Fins 44 are attached to structure 46. System 38 is constructed such that portions of fins 40 and fins 44 are in contact, nearly in contact or can be rotated such that this is the case. Then, when the medium in the container freezes, thermal transport bridges will form between portions of fins 40 and fins 44. In another aspect of this invention, fins 40 and 44 need not be parallel. Fins 40 and 44 can be angled with respect to each other such that gap 45 varies along the length of fins 40 and 44.

Figure 6:
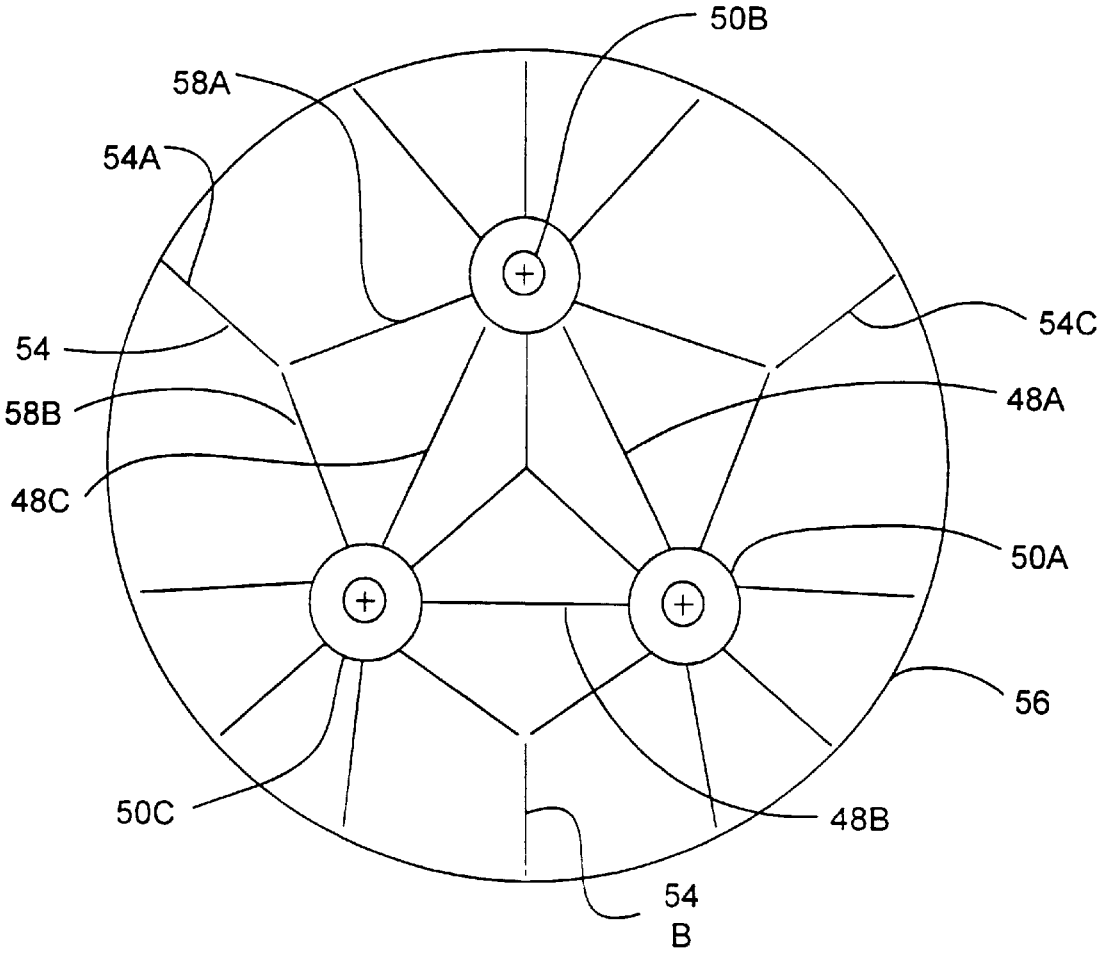
FIG. 6 depicts a number of possible fin geometries and combinations.

FIG. 6 depicts a number of possible arrangements of fins. For example, fin 48A may be partially coupled to structure 50A and a distal end placed in close proximity to another structure, 50B, such that the thermal bridge is formed between the distal end of fin 48A and structure 50B Fins 54 are coupled to interior wall 56. A distal end of fin 54A is placed near distal ends of fins 58, and fins 58 are coupled to structures 50. A thermal bridge will form between the distal ends of fins 54A, 58A and 58B. Thus, a thermal bridge can be formed between more than two fins. Forming a thermal bridge between two or more fins may be desirable if, for example, design constraints or other constraints require portions of the container to be held a distance from an actively cooled surface. A fin and thermal bridge can be used to help extract heat from the isolated structure.

Figure 7:
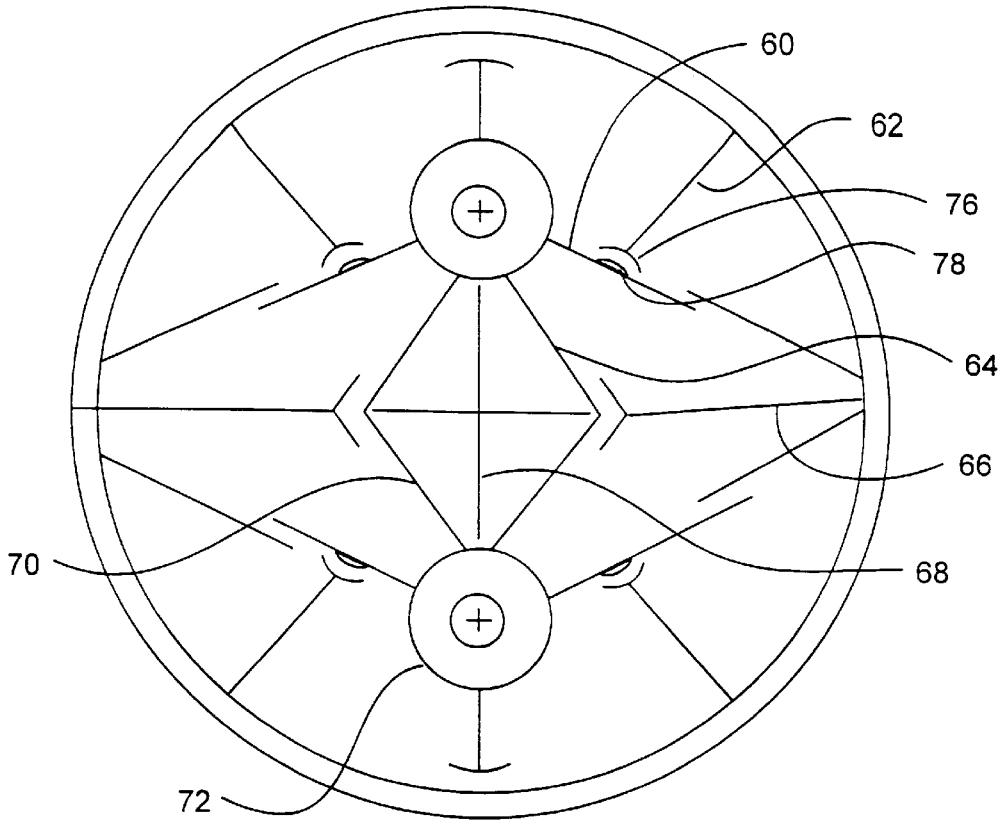
FIG. 7 depicts yet more possible fin geometries and combinations.

FIG. 7 depicts a number of other possible arrangements of fins. A fin can be configured so that the thermal bridge is formed not between the distal ends of two fins but between the distal end of one fin and some other portion of another fin. For example, fin 60 will form a thermal bridge with fin 62 at a central portion of fin 60, and fin 64 will form a thermal bridge with fin 66 at a central portion of fin 64. Furthermore, a fin need not be initially coupled to anything and thermal transport bridges may be formed between portions of the fin and other portion of the system. For example, fin 68 is not rigidly attached to any structure within the container, but it will form a thermal bridge with fins 64 and 70 and structures 72.

Additionally, fins may have structures on them to aid in the formation of thermal transport bridges or to enhance the thermal transport capabilities of the bridges. Fins 62 have extended surfaces 76 on their distal ends. Extended surface 76 will allow a wider thermal bridge to be formed, improving the heat transfer rate of the bridge. This may be desirable in certain circumstances. For example, the thermal transport properties of the fin material may be superior to those of the frozen material that forms the thermal bridge. Increasing the area of the thermal bridge will improve its total heat transfer properties.

Additionally, other types of extended surfaces can be put on fins, the structures or the interior surface of the container to aid in the formation of thermal transport bridges with the desired properties. For example, extended surface 78 may be used to enhance the formation of a thermal bridge with fin 62 whether or not extended surface 76 is attached to fin 62.

Figure 8:
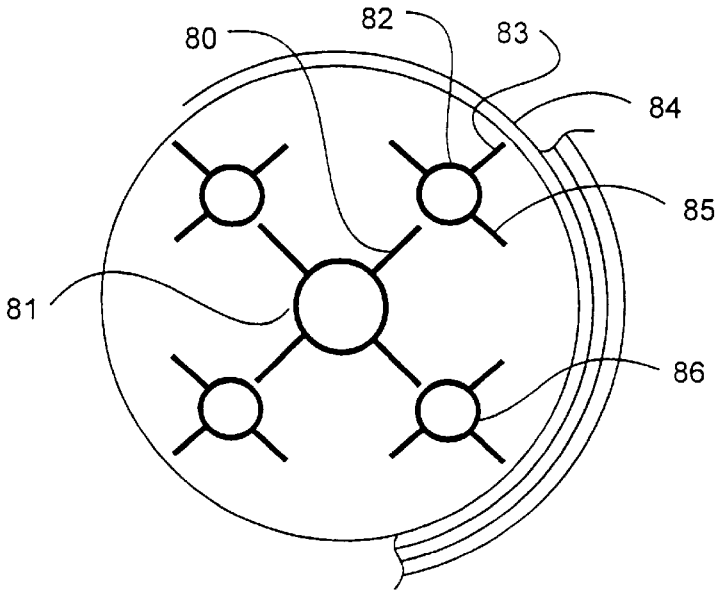
FIG. 8 depicts still another possible configuration of fin geometries and combinations.

FIG. 8 shows another embodiment of the present invention. This embodiment details another configuration of fins in accordance with the present invention. In this embodiment fins 80 are connected to structure 81 and will form thermal bridges with structures 82. Fins 83 are connected to structures 82 and will form thermal bridges with interior container wall 84. Fins 85 will form thermal bridges with each other, and fins 86 will form thermal bridges with interior container wall 84

Figure 9:
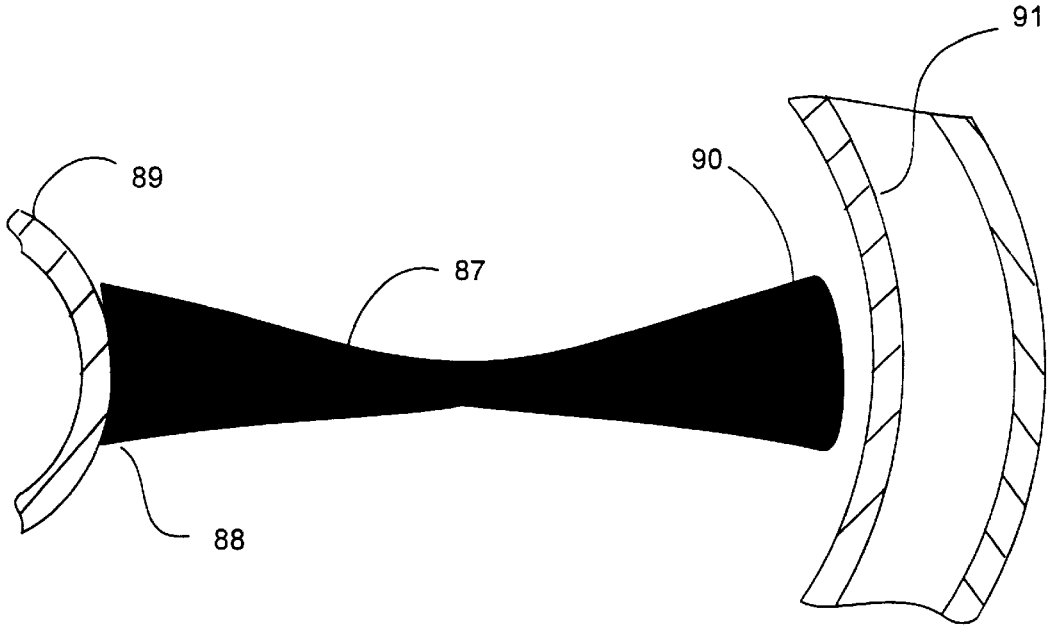
FIG. 9 depicts a cross-sectional view of a fin showing a non-uniform thickness.

FIG. 9 shows yet another embodiment of the present invention. Fin 87 has a non-uniform cross section along its length. Fin 87 is thicker at end 88 where it connects to structure 89 and thinner in its central portion. The fin then widens out at its distal end 90 where it is in close proximity to interior surface 91 A thermal bridge will form between distal end 90 and interior surface 91. The thicker base of the fin will allow more heat flux to be withdrawn from the fin at end 88 and distal end 90.

Figure 10:
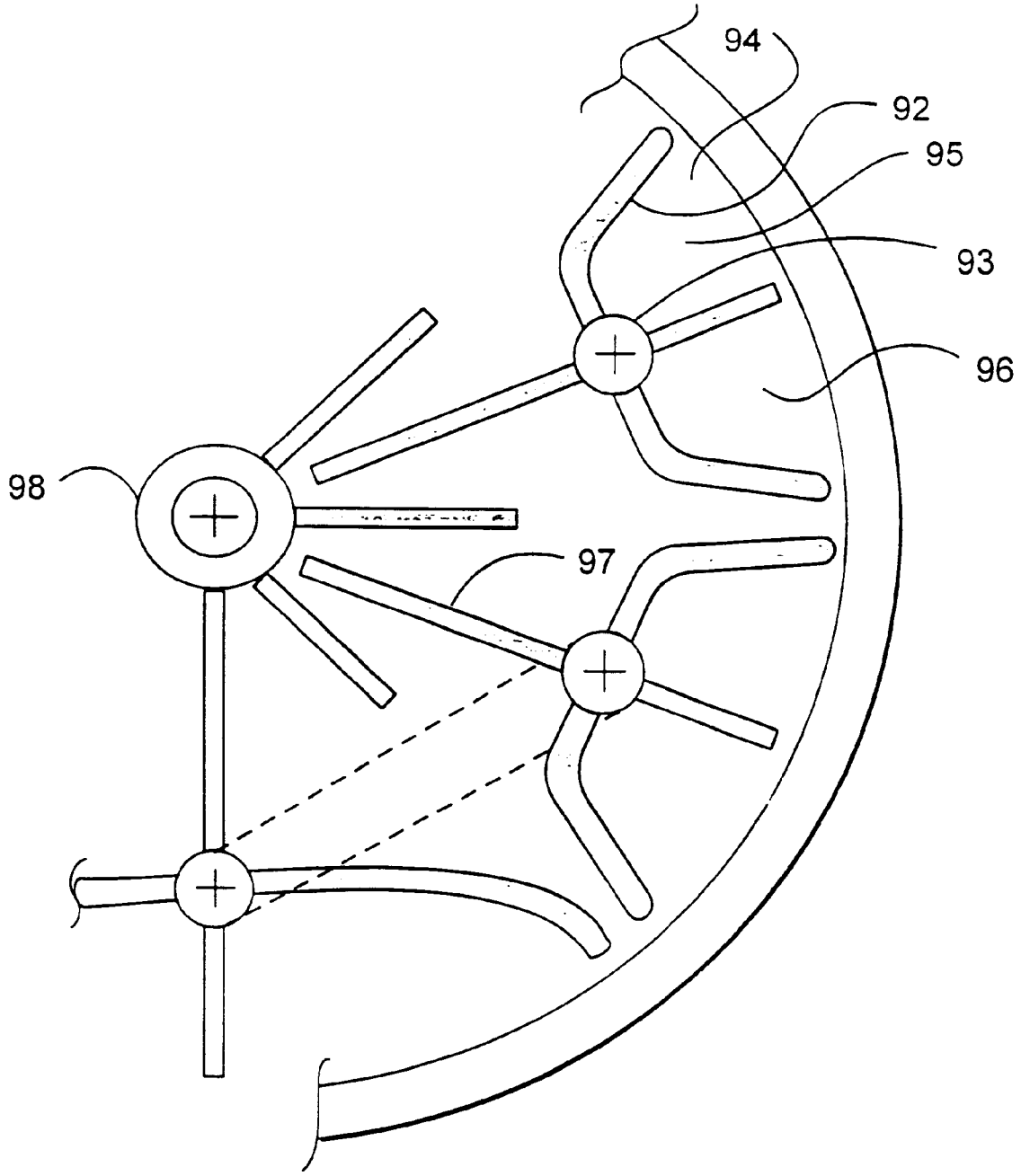
FIG. 10 depicts a fins geometry which allows compartmentalization of the container through the use of alternate fin geometries.

FIG. 10 shows still another embodiment of the present invention. Fins 92 are attached to structure 93 and will form thermal bridges with container wall 94. Fins 92 are curved to form compartments 95. Compartmentalization of the container allows more uniform cooling to be achieved since the distance from any point in the medium to a cooled surface is reduced. Also, the reduction in distance between cooled surfaces can be used to decrease the time required to freeze a medium. Other fins such as fins 96 may be added to further compartmentalize compartments 95. Fins 97 can also be used to form thermal bridges with another structure 98. Those skilled in the art will realize that other shapes and configurations of fins can be used to create more or less compartments of any desired size, and that this scheme can be scaled to any desired container volume without departing from the present invention.

Figure 11:
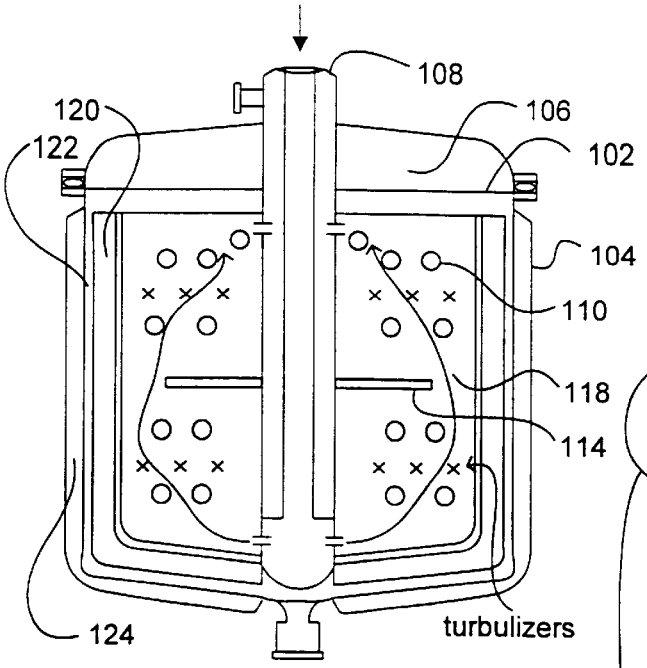
FIG. 11 is a cutaway view showing a container and the interior baffles of two fins.

FIG. 11 shows another embodiment of the present invention. In this embodiment fins 102 have interior passageways 104. Heat exchange fluid flows into interior passageways 104 through openings 106 in structure 108. Fins 102 may have dimples 110 or spacers 114 or turbulizers to help optimize the flow pattern 118 of the heat exchange fluid. Dimples or spacers help optimize the flow pattern 118 of the heat exchange fluid for reasons including, increasing the interior surface area of the fin which comes in contact with the heat exchange fluid, and giving the heat exchange fluid more time to absorb heat from the fins. This speeds the freezing process and allows converging of the dendrites more quickly.

Figure 12A:
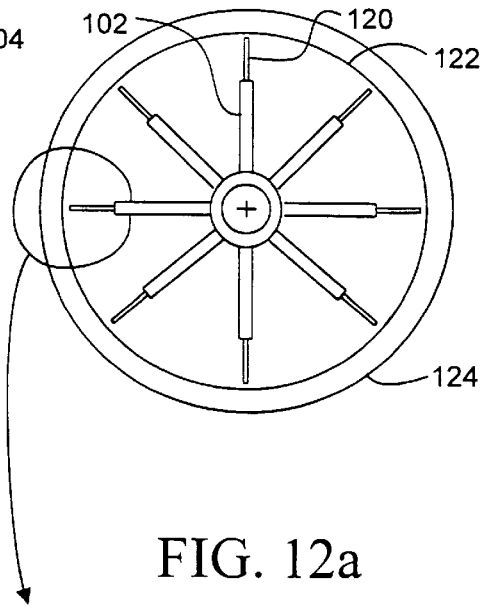
FIG. 12*a* is a top view of the container and fins of FIG. 11.
Figure 12B:
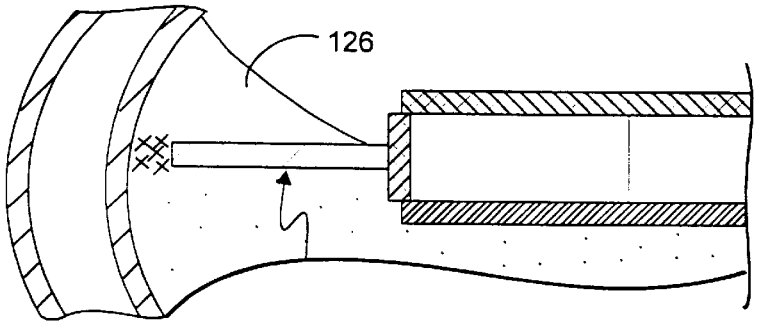
FIG. 12*b* is a detail view of the distal end of a fin with an extension extending close to the interior wall of the container.
Figure 12C:
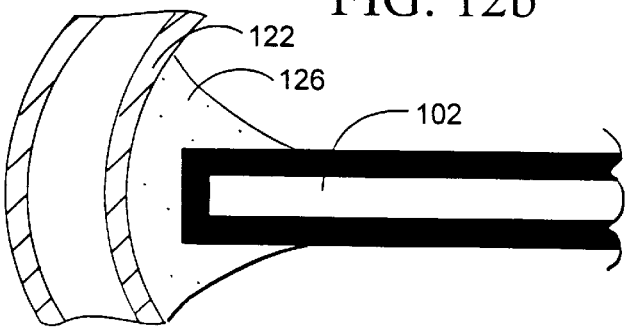
FIG. 12*c* is a detail view showing another embodiment of a fin without an extension in which the hollow fins structure extends close to the interior wall of the container.

In another aspect of the present invention, fins 102 may have extensions 120 on them. As shown in FIG. 12*a*, heat exchange fluid does not flow within extensions 120. Extensions 120 are connected to fins 102 and extend close to interior surface 122 of container 124. FIG. 12*b* shows a detail view of fin 102, extension 120 and interior surface 122. FIG. 12*c* shows a detail view of another embodiment of the present invention in which there is no extension placed on the end of fin 102.

As show in FIG. 12*b*, when the present invention is used to freeze a medium within container 124, a thermal transfer bridge 126 will begin to form between interior surface 122 and extension 120. In FIG. 12*c*, the thermal transfer bridge will begin to form between fin 102 and interior surface 122.

Figure 13:
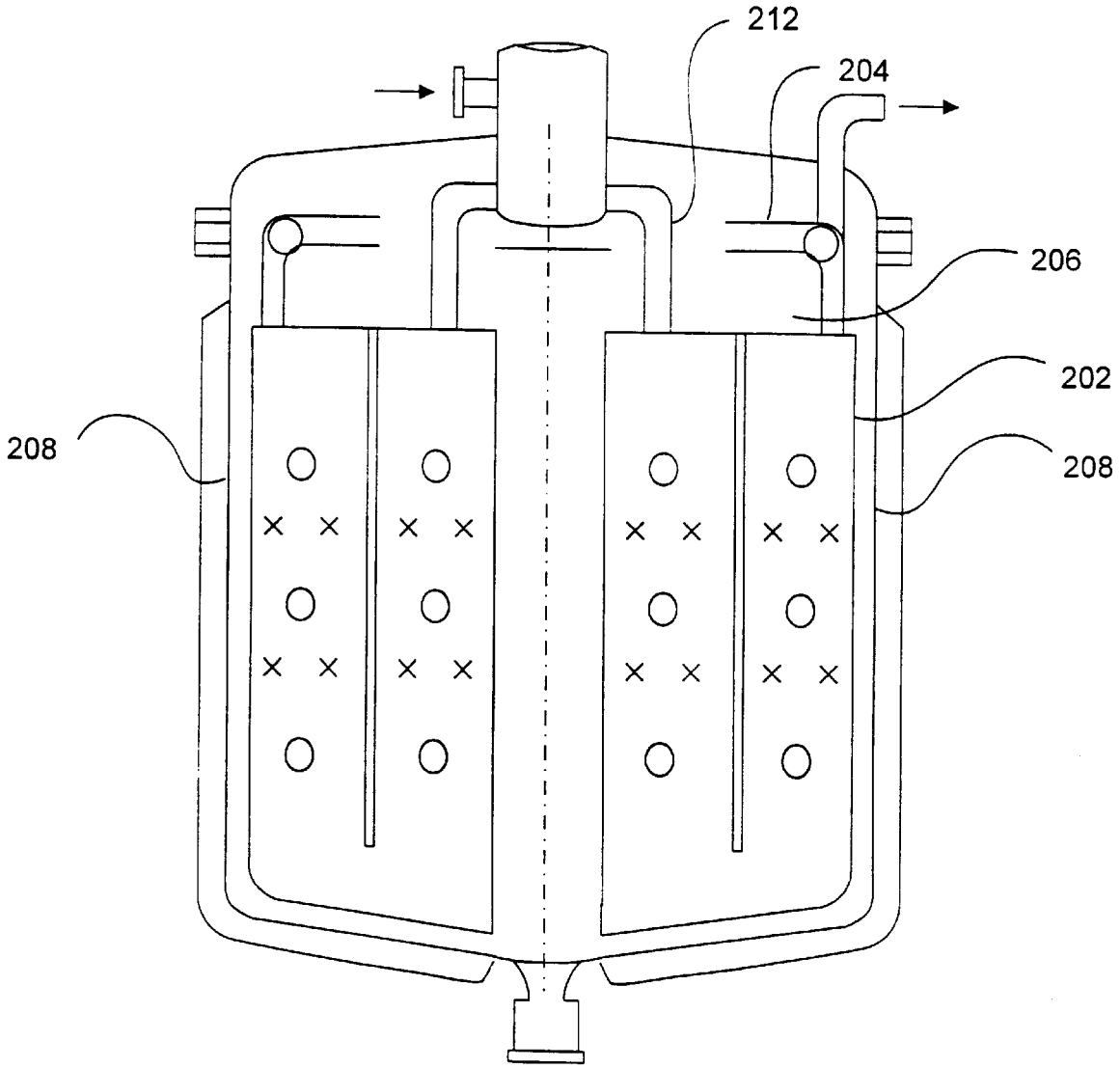
FIG. 13 is a cutaway view showing a container, the interior baffles of two fins, and no central structure. The heat exchange fluid is fed into the fins through tubes in the top of the fins.

FIG. 13 shows yet another embodiment of the present invention. In this embodiment the heat exchange fluid flows into and out of fins 202 through tubes 204 connected to the top 206 of fins 202. In this embodiment the fins are not connected to a central structure. When this embodiment is used to freeze a medium, thermal transfer bridges 208 will form between the fins 202 and the interior surface 210 and between interior portions 212 of fins 202.

Figure 14A:
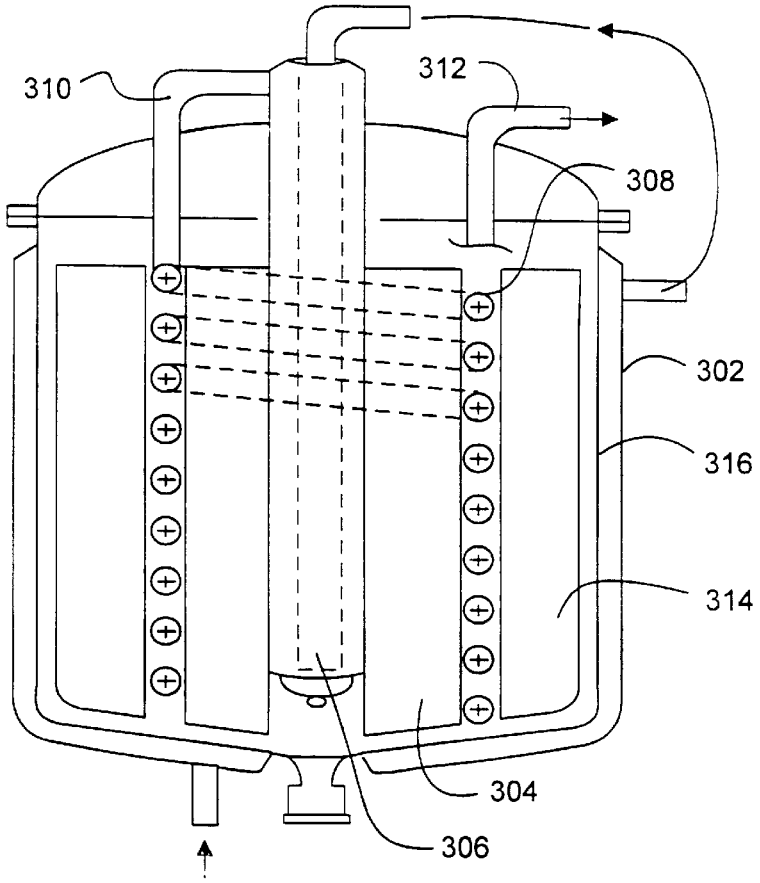
FIG. 14*a* is a cutaway view showing a container, a set of interior fins, a set of exterior fins and a coil.

FIG. 14*a* depicts yet another embodiment of the present invention. In this embodiment, system 300 has internal fins 304 which are attached to structure 306. Heat exchange fluid flows through structure 306. The flow of the heat exchange fluid can be configured to be similar to the flow described for structure 8 in FIG. 1. Any other flow configuration can be used to achieve a desired cooling or heating rate. Additionally, heat exchange fluid may be flowed through interior fins 304 if desired.

Coil 308 is placed in a surrounding relationship to interior fins 304. Heat exchange fluid flows into coil 308 through input 310 and flows out through output 312. Exterior fins 314 are placed between coil 308 and interior surface 316 of container 302. In one aspect of this embodiment, exterior fins can be free standing, attached to coil 308 or attached to interior surface 316. In another aspect of this embodiment, heat exchange fluid can be flowed through exterior fins 314 through coil 308, interior surface 316, external inputs, or any other supply.

In this embodiment, thermal transport bridges are formed between interior fins 304 and coil 308, coil 308 and external fins 314, external fins 314 and interior surface 316, and the coils of coil 308.

Figure 14B:
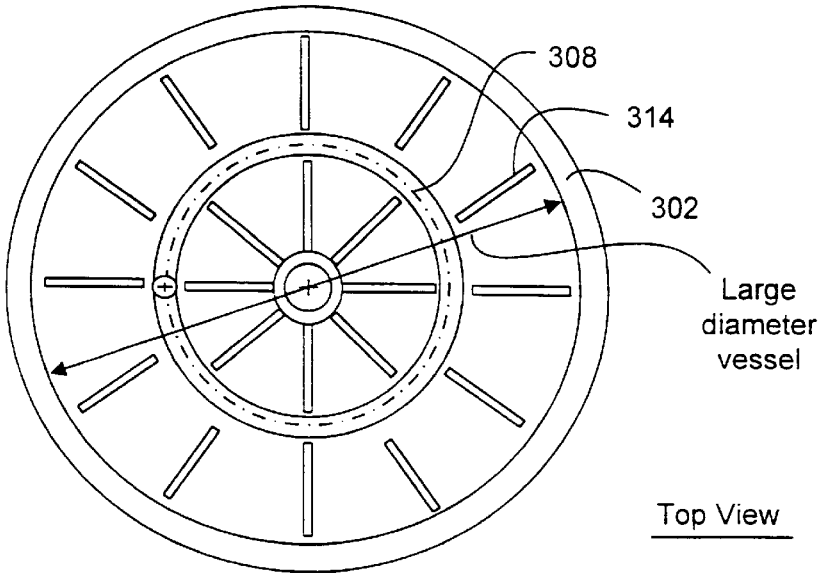
FIG. 14*b* is a top view of the system of FIG. 14*a*.

FIG. 14*b* show a top view of system 300. In this embodiment fins 314 are depicted as not being attached to coil 308. Fins 314 could be suspended by supports from the top or bottom of container 302 or fins 314 could be free standing.

FIG. 15 depicts still another embodiment of the present invention. In this embodiment system 400 has internal fins 402 attached to structure 404 and first coil 406 surrounding internal fins 402. Middle fins 408 are placed around first coil 406 and second coil 410 surrounds middle fins 408. Exterior fins 412 are placed between second coil 410 and interior surface 414. First and second coils 406 and 410 receive heat exchange fluid through input 416 and 418 respectively and the heat exchange fluid flows out through outputs 420 and 422 respectively.

Figure 15A:
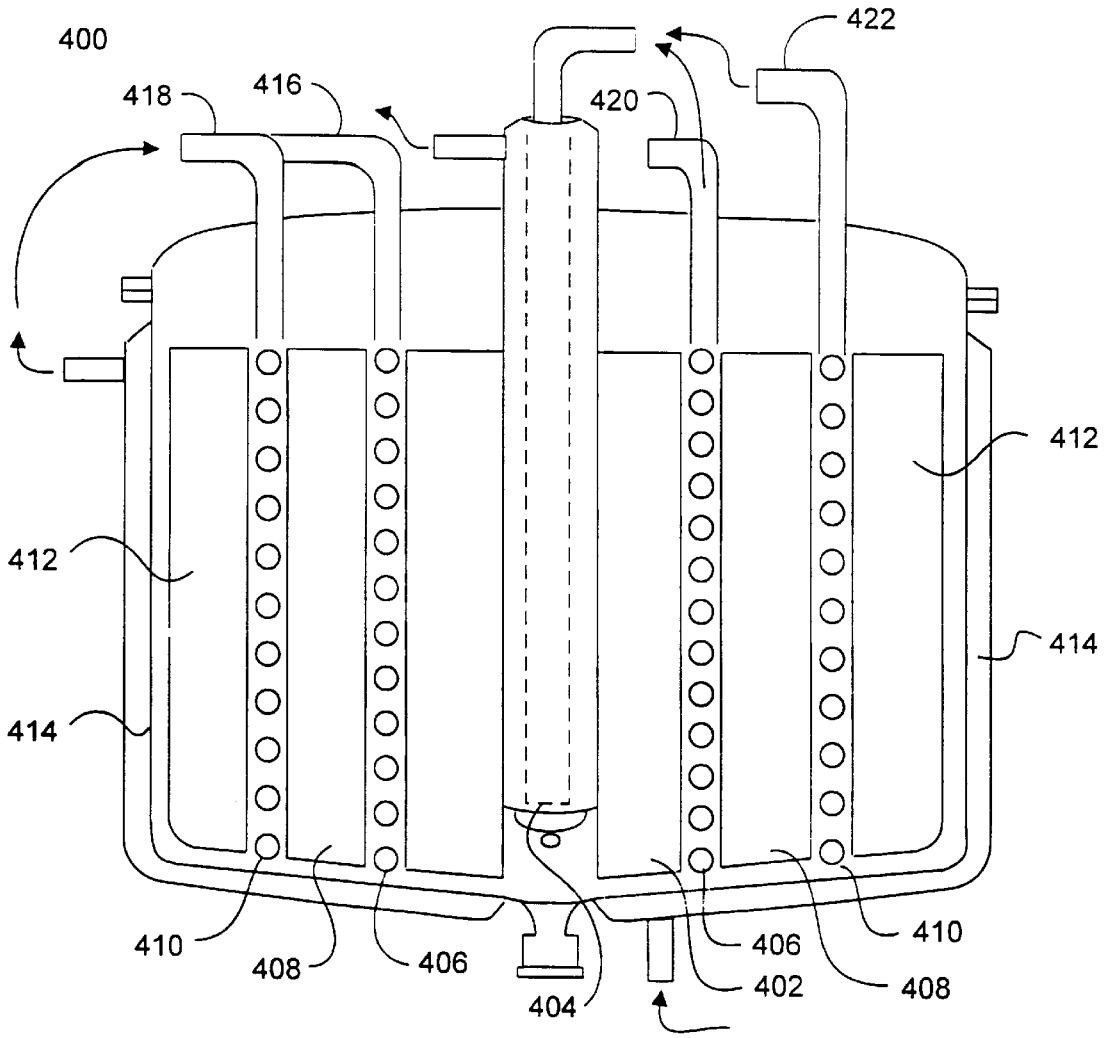
FIG. 15*a* is a cutaway view showing a container, a set of interior fins, a set of middle fins, a set of exterior fins, a first coil, and a second coil.
Figure 15B:
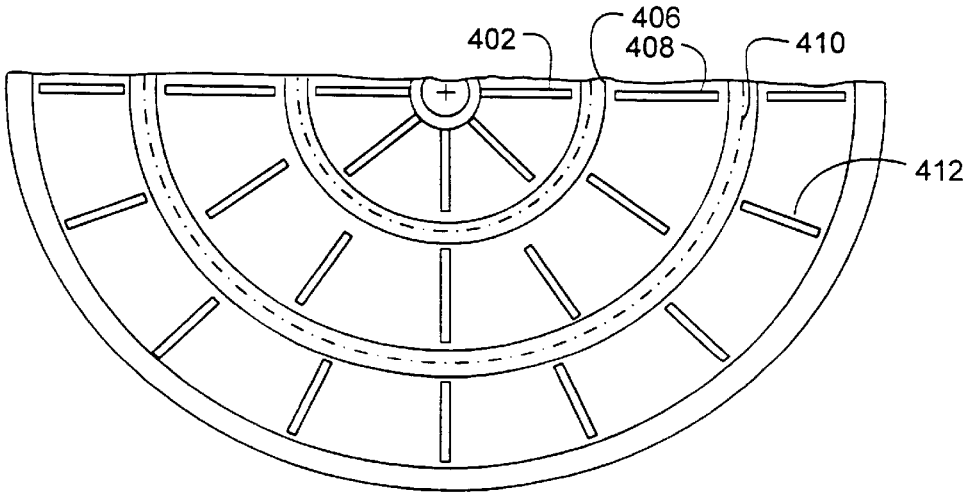
FIG. 15*b* is a top view of the system of FIG. 15*a*.

FIG. 15*b* shows a top view of this embodiment. In this embodiment fins 408 and 412 are depicted as freely suspended. Thermal transport bridges will form between internal fins 402 and first coil 406, the coils of first coil 406, first coil 406 and middle fins 408, middle fins 408 and second coil 410, the coils of second coil 410, second coil 410 and exterior fins 412, and exterior fins 412 and interior surface 414.

Figure 15C:
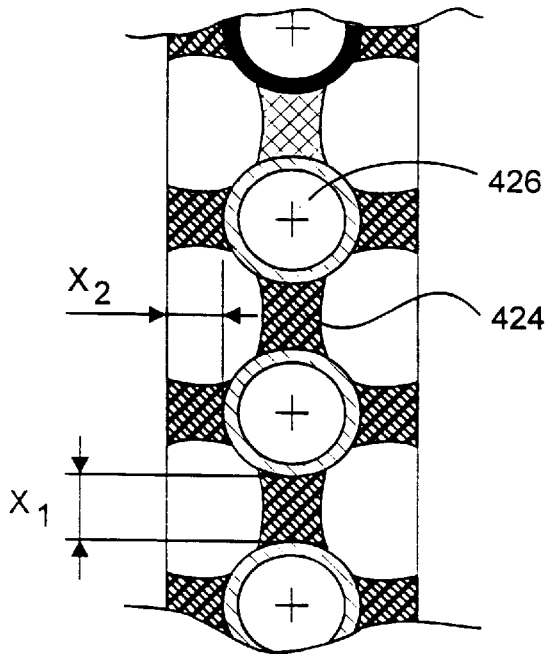
FIG. 15*c* is a detailed side view of the thermal bridges that form between each of the winds of the coils and between the fins and the winds of the coils.
Figure 15D:
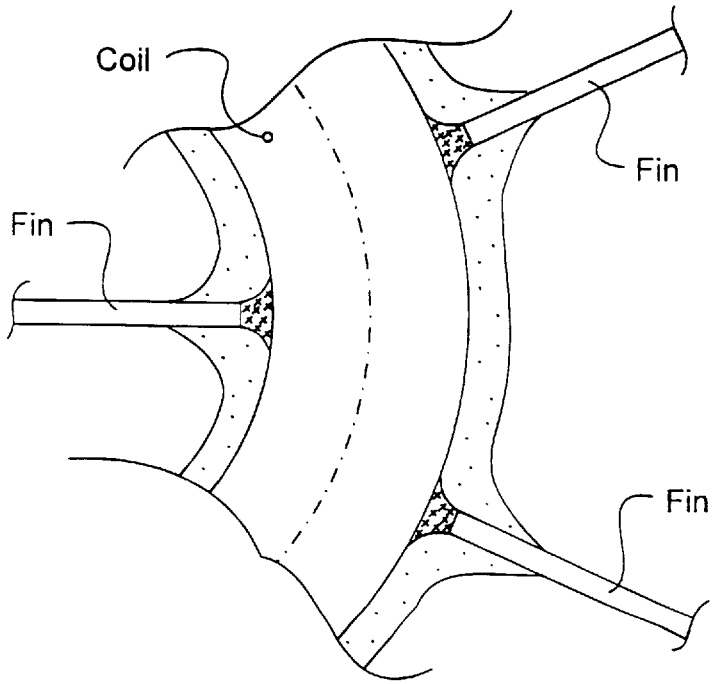
FIG. 15*d* is a detailed top view of the thermal bridges that form between the coils and the fins.

FIG. 15*c* shows a detail side view of the formation of the thermal transport bridges 424 between the coils of one of first coil 406 or second coil 410, and the thermal transport bridges 426 formed between the coils and fins, interior fins middle fins or exterior fins. Distances X1 and X2 can be optimized as desired as a function of the properties of the fins the coil the medium and the,container. The FIG. 15*d* shows a top view of the formation of the thermal bridges depicted in FIG. 15*c*.

Figure 16A:
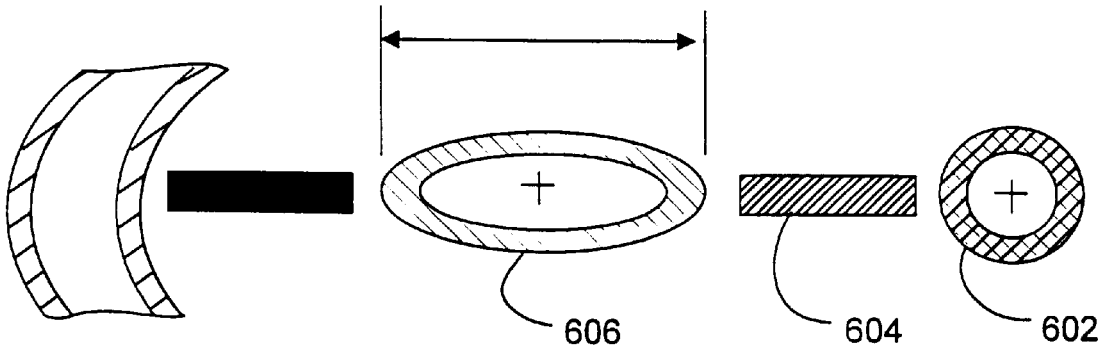
FIGS. 16 depicts non-circular cross-section tubes.
Figure 16B:
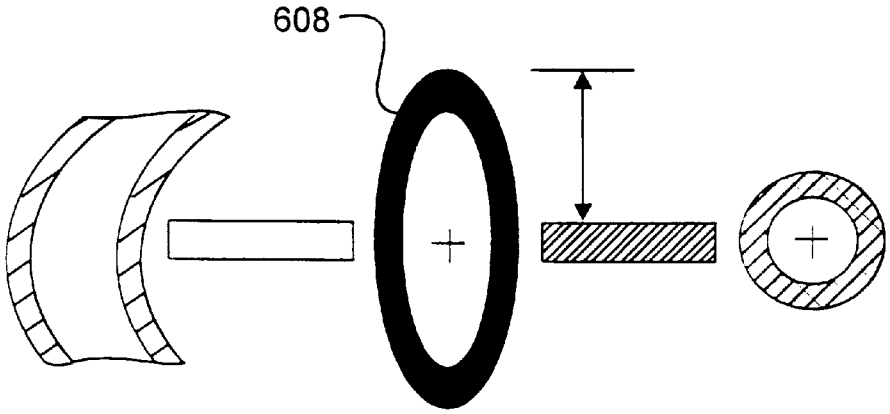

FIGS. 16 show other possible configurations of coils consistent with the present invention. In FIG. 16*a*, central pipe 602 has a round cross section. Cooling fluid flows through the interior of pipe 602. Central pipe 602 is adjacent to and will form a thermal bridge with fin 604. Pipe 606 also has cooling fluid flowing through it, and it is adjacent to the other end of fin 604. Pipe 606 has a non-circular cross-section. Any cross-section pipe can be used consistent with the present invention. In FIG. 16*b*, a non-circular cross-section pipe 608 is show in a different orientation with respect to the adjacent fins.

Figure 17A:
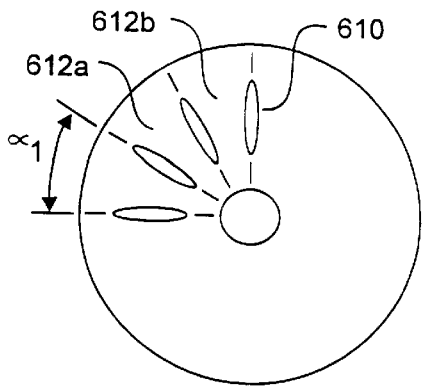
FIGS. 17 depict non-circular cross-section tubes in use in a system.

FIG. 17 shows non-circular cross-section pipes used in a system. In FIG. 17*a*, the angle formed between two adjacent fins is small and therefore the non-circular cross section pipes 610 are oriented so that they can be placed closer together. One advantage of using non-circular cross-section pipes is that the elongated surface area of non-circular pipes 610 allows for a longer portion of the interface between compartments 612 to be cooled by a pipe with a cooling medium flowing through it.

Figure 17B:
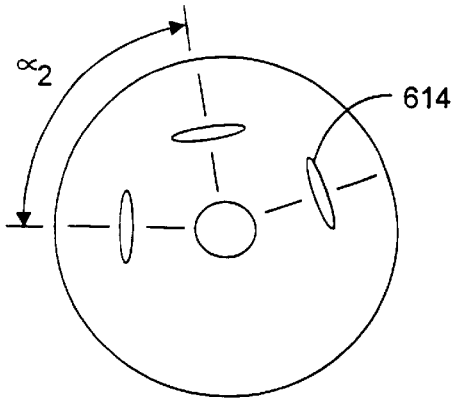
Figure 18A:
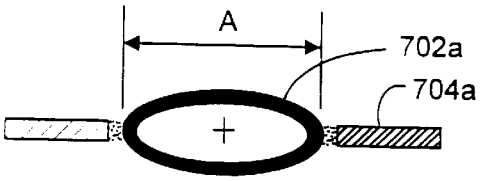
FIGS. 18 depict non-circular cross-section tubes attached to fins in various configurations.
Figure 18B:
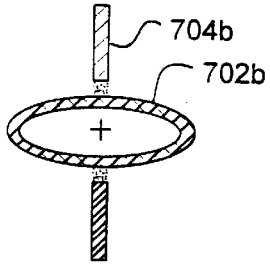
Figure 18C:
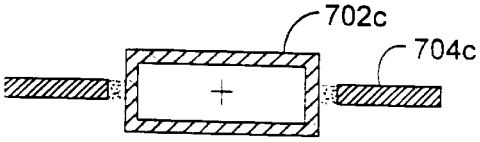
Figure 18D:
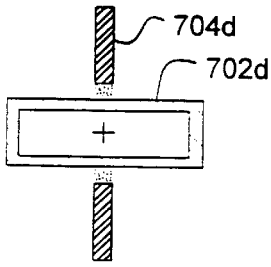
Figure 18E:
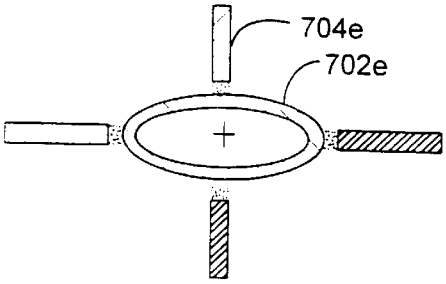
Figure 18F:
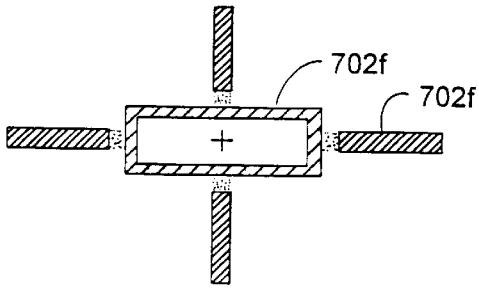

FIG. 17*b* shows non-circular cross-section pipe 614 used in a different orientation from that in FIG. 17*a*. In FIG. 17*b*, the angle formed by adjacent fins is larger and therefore non-circular cross-section pipes 614 can be used in the orientation shown. In the orientation shown, non-circular cross-section pipes 614 protrude into the adjacent compartments and advantageously help to more uniformly cool the medium within the compartments.

FIG. 18 shows another configuration of pipes and fins that is consistent with the present invention. In FIG. 18, the non-circular cross-section pipes 702 have fins 704 welded onto them.

Figure 19A:
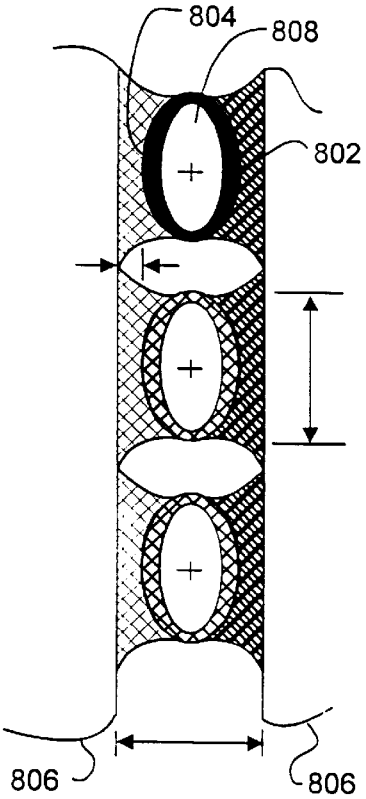
FIGS. 19*a* and 19*b* depict non-circular cross-section tubes in use in a coil configuration within a system.
Figure 19B:
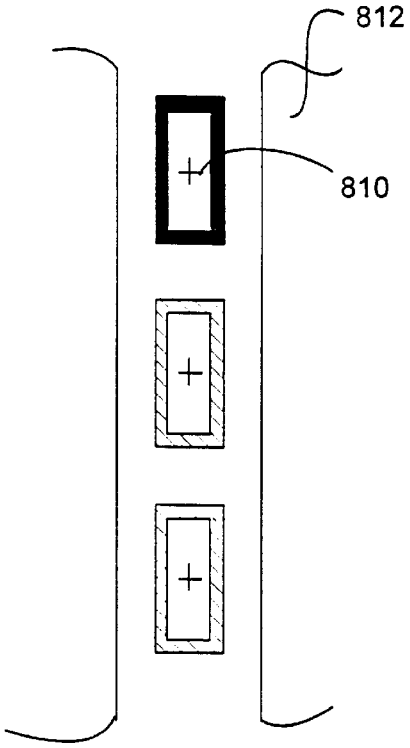

FIGS. 19 show yet another example of the use of non-circular cross-section fins consistent with the present invention. In FIG. 19*a* a non-circular cross-section pipe 802 is wound into a coil, similar to coil 308 of FIG. 14*a*. Non-circular cross-section pipe 802 has extended flat side 804 adjacent to fms 806. Extended flat side 804 makes it easier for thermal bridges to form between coil 808 formed by pipes 802 and fins 806, and between pipes 802 of coil 808. FIG. 19*b* shows pipes 810 of a different cross-section which also advantageously aid in the formation of thermal bridges.

Non-circular cross-section pipes 802 or 810 allow fins 806 or fins 812 to be closer together for a given internal pipe cross-sectional area when compared to a circular pipe. Since the fins are closer together, thermal bridges will form more quickly, speeding up the freezing process and keeping it more uniform.

Figure 20:
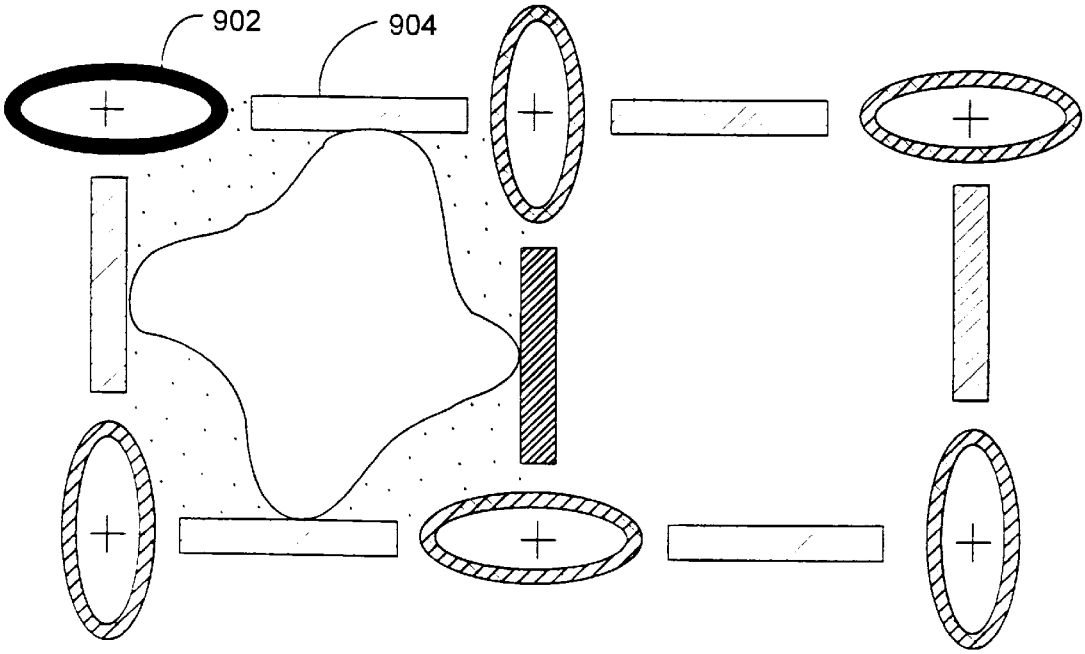
FIG. 20 depicts a configuration of non-circular cross-section tubes and fins useful for compartmentalizing a system.

FIG. 20 details yet another possible configuration of non-circular cross-section pipes 902 and fins 904. The geometry shown can be used to compartmentalize large volume tanks. The compartments thus formed can be made as small as is needed in order to achieve a desired level of uniformity.

The present invention can be usefully applied in many fields. For example in the biopharmaceutical industry the present invention can be used to freeze and preserve a variety of biopharmaceutical products, including but not limited to proteins, cells, antibodies, medicines, plasma, blood, buffer solutions, viruses, serum, cell fragments, cellular components, and any other biopharmaceutical product.

Additionally, the present invention allows processing of such biopharmaceutical products consistent with generally accepted manufacturing procedures.

One could use the present invention to freeze a biopharmaceutical product by sterilizing the container, pumping the product to be frozen into the container through a sterile filter and then removing heat from the product using the present invention to freeze the product within the container.

The present invention promotes uniform freezing at a rapid pace which allows the product in the container to be frozen in as close to its native state as possible. Additionally, the present invention allows the freezing process to be done in a repeatable fashion so that a user can be assured that the freezing process is not causing batch to batch variations in the product. This allows the end use of the product to be decoupled from the manufacturing steps needed to create the product since the product can be stored in the frozen state after it is manufactured, and thawed when and where it is needed.

The present invention can also be used during any stage of a purification process. For example, after products are processed using size separation or affinity separation, fermentation, licing, concentration filtration, selective affinity chromatography, removal of micro contaminants or low level impurities through ion exchange, viral filtration, chromatography, putting the product in a buffered solution delivery system, or after any other processing step the resulting product can be stored using the present invention. This allows a hold to be put on the manufacturing process without degrading the intermediate product.

For example, if during a manufacturing process in which various components are being separated, one wishes to put a hold on the processing, there may be contaminating proteaises in the intermediate product which may, over time, degrade some of the proteins of interest in the product. The present invention can be used to freeze the intermediate product quickly and uniformly enough so that the product remains close to its native state. The molecules in the product are not brought significantly closer together—freeze concentration is reduced, and unwanted reactions can be slowed or stopped.

These examples do not limit the present invention but are merely examples of possible embodiments of the present invention. Other embodiments are possible without deviating form the present invention.

What is claimed is:

1. A method of processing biopharmaceuticals comprising:

providing a container for receiving a medium, the medium comprising a biopharmaceutical product, said container comprising a jacket on an outer wall of the container for receiving a flow of heat exchange fluid;

positioning a structure in said container, and a heat exchange fluid flowing through the structure;

coupling a heat exchange member to an interior surface of the container wherein a distal end of the heat exchange member is placed in close spaced proximity to the structure thereby defining a gap between the heat exchange member and the structure;

introducing the medium into the container; and forming a thermal transfer bridge in the gap between the heat exchange member and the structure, wherein the thermal transfer bridge conducts heat out of the medium.

2. The method of claim 1 further comprising:

a heating or cooling device coupled to and providing heating or cooling of the structure.

3. The method of claim 1 further comprising:

a heating or cooling device coupled to and providing heating or cooling of the heat exchange member.

4. The method of claim 1 further comprising:

a heating or cooling device coupled to and providing heating or cooling of the container and the structure.

5. The method of claim 1 further comprising:

a plurality of heat exchange members.

6. The method of claim 1 wherein:

a volume of the container is in the range from substantially 1 liter to 250 liters.

7. The method of claim 1 wherein:

a volume of the container is in the range from substantially 250 liter to 10,000 liters.

8. The method of claim 1 wherein:

the distal end of the heat exchange member contacts at least a portion of the structure.

9. The method of claim 1 wherein:

a distance between the distal end of the heat exchange member and the structure is a non-contacting distance not greater than one inch.

10. The method of claim 1 wherein:

said jacket defines an interstitial space positioned between the jacket and said outer wall of the container for receiving a flow of a heat exchange fluid, the jacket further including a plurality of spiral baffles for enhancing thermal exchange between the heat exchange fluid and the container.

11. The method of claim 1 wherein:

the medium is substantially uniformly heated or cooled.

12. The method of claim 1 wherein:

the medium is heated or cooled in substantially one direction relative to the structure.

13. The method of claim 1 wherein:

the heat exchange member is positioned to induce a thermal gradient in the medium such that the thermal gradient is in a predetermined direction.

14. The method of claim 1 wherein:

the medium is heated or cooled in a predetermined direction.

15. The method of claim 1 wherein:

the medium is heated or cooled such that a thermal gradient is in a predetermined direction.

16. The method of claim 1 further comprising:

the medium is heated or cooled such that a thermal gradient is in a predetermined direction and heating or cooling of the medium occurs at a predetermined rate.

17. The method of claim 1 wherein:

the container has a nonporous bottom.

18. The method of claim 1 wherein:

the container has nonporous walls.

19. The method of claim 1 wherein:

the container has a top.

20. The method of claim 1 wherein:

the container has a nonporous top.

21. The method of claim 1 wherein:

the medium includes proteins.

* * * * *